US011549320B2

(12) United States Patent
Taggart

(10) Patent No.: US 11,549,320 B2
(45) Date of Patent: Jan. 10, 2023

(54) PIPE HANDLER APPARATUS

(71) Applicant: DRILLFORM TECHNICAL SERVICES LTD., Calgary (CA)

(72) Inventor: Mark Taggart, Calgary (CA)

(73) Assignee: DRILLFORM TECHNICAL SERVICES LTD., Calgary (CA)

( * ) Notice: Subject to any disclaimer, the term of this patent is extended or adjusted under 35 U.S.C. 154(b) by 0 days.

(21) Appl. No.: 17/274,902

(22) PCT Filed: Sep. 11, 2019

(86) PCT No.: PCT/CA2019/051290

§ 371 (c)(1),
(2) Date: Mar. 10, 2021

(87) PCT Pub. No.: WO2020/051705

PCT Pub. Date: Mar. 19, 2020

(65) Prior Publication Data

US 2022/0056770 A1 Feb. 24, 2022

Related U.S. Application Data

(60) Provisional application No. 62/729,785, filed on Sep. 11, 2018.

(51) Int. Cl.
*E21B 19/15* (2006.01)

(52) U.S. Cl.
CPC ..... *E21B 19/155* (2013.01)

(58) Field of Classification Search
CPC ..... E21B 19/155; E21B 19/15
USPC ..... 414/22.51–22.71
See application file for complete search history.

(56) References Cited

U.S. PATENT DOCUMENTS

| | | | |
|---|---|---|---|
| 2,558,554 | A | 6/1951 | Harvey |
| 2,589,181 | A | 3/1952 | Yount |
| 2,790,683 | A | 4/1957 | Clark |
| 2,958,430 | A | 11/1960 | Robishaw |
| 3,034,668 | A | 5/1962 | Wicks |
| 3,159,286 | A | 12/1964 | Freeman |

(Continued)

FOREIGN PATENT DOCUMENTS

| | | |
|---|---|---|
| AU | 2011265472 | 1/2012 |
| CA | 2183290 | 2/1997 |

(Continued)

OTHER PUBLICATIONS

International Search Report and Written Opinion for PCT/CA2015/050174, dated May 21, 2015, 7 pages.

(Continued)

*Primary Examiner* — Lynn E Schwenning
(74) *Attorney, Agent, or Firm* — Sheridan Ross P.C.

(57) ABSTRACT

Some embodiments of the present disclosure relate to pipe handling apparatus that comprise a base, an elongate door, a pipe carrier and a lift member. In some embodiments the lift member is pivotally connected at one end to the base and pivotally connected to the pipe carrier at the other end. In some embodiments, the apparatus includes further features that provide full capture of the pipe carrier by the elongate door and the lift member. In some embodiments the pipe carrier is moved substantially along the elongate door by a combined actuator, shiv and cable system.

9 Claims, 19 Drawing Sheets

(56) References Cited

U.S. PATENT DOCUMENTS

| | | | | |
|---|---|---|---|---|
| 3,169,645 | A | 2/1965 | Freeman | |
| 3,706,347 | A | 12/1972 | Brown | |
| 3,780,883 | A | 12/1973 | Brown | |
| 3,785,506 | A | 1/1974 | Crocker et al. | |
| 3,810,553 | A | 5/1974 | Crocker et al. | |
| 3,956,901 | A | 5/1976 | Brown | |
| 4,067,453 | A | 1/1978 | Moller | |
| 5,147,448 | A | 9/1992 | Roberts et al. | |
| 5,522,699 | A | 6/1996 | Smith | |
| 6,722,931 | B2 | 4/2004 | Eberl | |
| 6,877,942 | B2 * | 4/2005 | Eastcott | E21B 19/155 414/22.58 |
| 7,022,155 | B2 | 4/2006 | Deegan et al. | |
| 7,635,249 | B2 * | 12/2009 | Guidroz | E21B 19/14 414/22.52 |
| 7,832,974 | B2 * | 11/2010 | Fikowski | E21B 19/155 414/22.58 |
| 7,992,646 | B2 | 8/2011 | Wright et al. | |
| 8,033,779 | B2 | 10/2011 | Gerber et al. | |
| 8,052,368 | B2 * | 11/2011 | Littlewood | E21B 19/15 414/22.58 |
| 8,764,368 | B2 | 7/2014 | Crossley et al. | |
| 8,840,352 | B2 | 9/2014 | Taggart et al. | |
| 9,518,432 | B2 * | 12/2016 | Miranda | E21B 19/155 |
| 9,845,646 | B2 * | 12/2017 | Dahmes | B66F 11/00 |
| 10,480,264 | B2 | 11/2019 | McCorriston et al. | |
| 10,738,545 | B2 * | 8/2020 | Clarke | E21B 19/155 |
| 2006/0104746 | A1 * | 5/2006 | Thompson | E21B 19/155 414/22.54 |
| 2007/0221385 | A1 | 9/2007 | Braun et al. | |
| 2009/0053013 | A1 | 2/2009 | Maltby | |
| 2010/0163247 | A1 | 7/2010 | Wright et al. | |
| 2011/0188973 | A1 * | 8/2011 | Baumler | E21B 19/08 414/22.57 |
| 2012/0027541 | A1 | 2/2012 | Gerber et al. | |
| 2013/0266404 | A1 | 10/2013 | Tolman et al. | |
| 2014/0133939 | A1 * | 5/2014 | Richardson | E21B 19/155 414/22.55 |
| 2014/0238745 | A1 | 8/2014 | Dahmes et al. | |
| 2015/0139773 | A1 | 5/2015 | Nikiforuk | |
| 2015/0184472 | A1 | 7/2015 | Miranda et al. | |
| 2016/0305203 | A1 * | 10/2016 | Guerra | E21B 19/155 |

FOREIGN PATENT DOCUMENTS

| | | |
|---|---|---|
| CA | 2508998 | 12/2006 |
| CA | 2873282 | 11/2013 |
| CA | 3008025 | 6/2017 |
| CN | 102787813 | 11/2012 |
| CN | 102926685 | 2/2013 |
| CN | 103089173 | 5/2013 |
| CN | 102787813 B | 6/2015 |
| GB | 2137261 | 10/1984 |

OTHER PUBLICATIONS

International Search Report and Written Opinion for PCT/CA2019/051290, dated Nov. 14, 2019, 10 pages.

Extended European Search Report for Application No. 16754693.6, dated Jul. 24, 2018, 12 pages.

Official Action for U.S. Appl. No. 15/552.423, dated Nov. 30, 2018 10 pages.

Final Action for U.S. Appl. No. 15/552,423, dated Mar. 13, 2019 6 pages.

Notice of Allowance for U.S. Appl. No. 15/552,423, dated Jul. 1, 2019 7 pages.

International Search Report and Written Opinion for PCT/CA2016/050174, dated May 10, 2016, 6 pages.

International Preliminary Report on Patentability for PCT/CA2016/050174, dated Sep. 8, 2017, 5 pages.

International Preliminary Report on Patentability for PCT/CA2019/051290, dated Mar. 25, 2021, 6 pages.

Extended European Search Report for Application No. 19858931.9, dated Jun. 24, 2022, 8 pages.

* cited by examiner

FIG. 17A
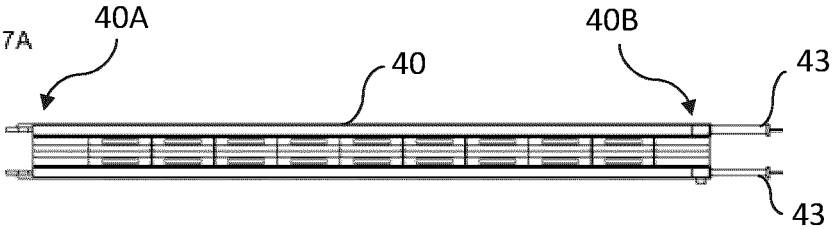
FIG. 17B
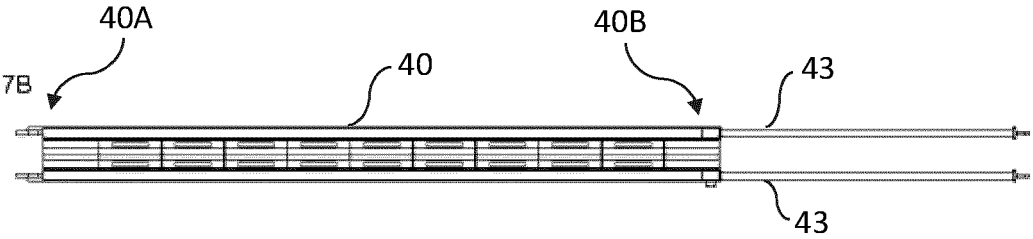
FIG. 17C
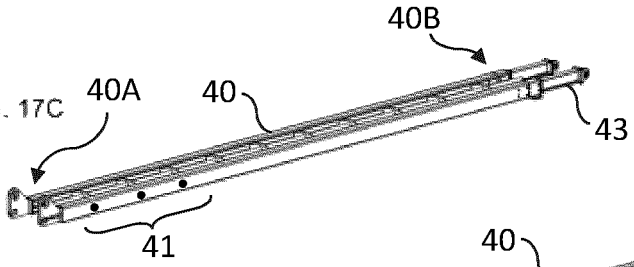
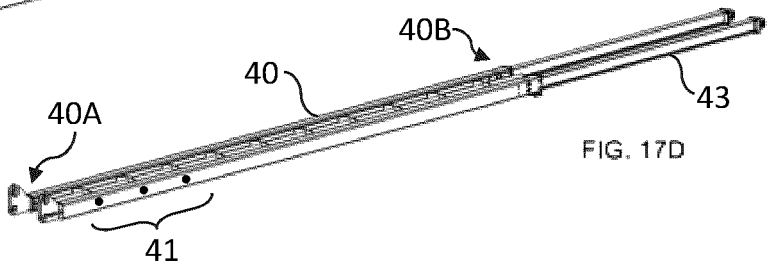
FIG. 17D
FIG. 17E
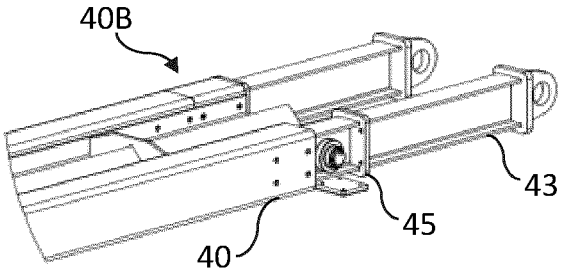

PIPE HANDLER APPARATUS

CROSS REFERENCES

This application is a national stage application under 35 U.S.C. 371 and claims the benefit of PCT Application No. PCT/CA2019/051290 having an international filing date of 11 Sep. 2019, which designated the United States, which PCT application claimed the benefit of U.S. Provisional Patent Application No. 62/729,785 filed 11 Sep. 2018, the entire contents of each of which are incorporated herein by reference.

TECHNICAL FIELD

The present disclosure relates to pipe handler apparatus and methods of handling pipe. In particular, the apparatus and methods of the present disclosure may be used to move objects between an elevated platform and a surface below the elevated platform.

BACKGROUND

Pipe handling apparatus are known for moving heavy pipes from a lower surface to an elevated surface and vice versa. Such heavy pipes can include components of a drill string, casing and other types of pipe and elongate tubulars that are used in forming and completing an oil and/or gas well.

During drilling or completion operations, the pipe is moved in two ways: (i) vertically, between the lower surface, which is typically the ground floor of a drilling rig or a completion rig, to an elevated operational floor upon the rig; and, (ii) rotationally, whereby the pipes move between a substantially-horizontal storage orientation to a substantially-vertical operational orientation, for insertion or extraction from the well below the operational floor of the rig.

These heavy pipes can weight upwards of about 15,000 pounds (one pound is equivalent to about 0.453 kilograms) and due to the typical round shape, the pipes must be handled carefully to avoid losing control of the pipe and causing catastrophic accidents.

SUMMARY

Some embodiments of the present disclosure relate to a pipe handling apparatus for use with an oil and gas well rig. The pipe handling apparatus comprising a base, an elongate door, a pipe carrier and a lift member. The base that is supportable by a first surface. The elongate door comprises a first end and a second end and is pivotally connected to the base at the second end. The elongate door is pivotally moveable about the second end between a collapsed position and an extended position. When the elongate door is in the extended position the first end is positionable to abut an operational floor of a rig. The pipe carrier comprises a first end and a second end that is supported by the base and that is configured to receive and support an elongate pipe. The lift member is supported by the base and is pivotally connected at a first end to the pipe carrier and pivotally connected at a second end to the base by a collapsible extension. The lift member is moveable along the base towards and away from the second end of the elongate door. When the lift member moves towards the second end of the elongate door, the collapsible extension collapses forming a pivot point and causing the first end of the lift member to moves upwardly and arcuately towards the elongate door.

Without being bound by any particular theory, the aforementioned embodiments of the present disclosure may provide the benefits of a lift arm that is connected at one end to the base and at the other to the pipe carrier. These connections may provide increased stability of the carrier arm as contrasted with other known pipe handler assemblies that are susceptible to being shifted backwards in their track if something disrupts the pipe carrier at or near the operational floor of the rig. For example, in known pipe handlers the pipe carrier can be accidentally pushed upwards, backwards, sideways or any combination thereof, and this can cause the lift member to move and collapse. This collapse can cause control of the pipe being carried to be lost and it is known source of accidents related to the use of pipe handlers. Furthermore, by having a collapsible extension at one end of the lift arm may decreases the incidence of the lift arm not properly abutting the base in order to properly pivot and raise the opposite end. This is referred to as "missing the pocket" and it can be caused by any number of reasons, such as user error or debris collecting within the base. If the lift member misses the pocket, this too causes the lift member and the pipe carrier to collapse and control of the pipe being carried to be lost.

Further embodiments of the present disclosure relate to a pipe handling apparatus for use with an oil and gas well rig. The pipe handling apparatus comprises a base, an elongate door, a pipe carrier and a lift member. The base is supportable by a first surface. The elongate door comprises a first end and a second end and is pivotally connected to the base at the second end. The elongate door is pivotally moveable about the second end between a collapsed position and an extended position. When the elongate door is in the extended position the first end is positionable to abut an operational floor of a rig. The pipe carrier is supported by the base and comprises a first end and a second end that is supported by the elongated door and that is configured to receive and support an elongate pipe. The second end comprising a bearing surface that is moveable along the elongate door. The lift member is supported by the base and the lift member is pivotally connected at a first end to the pipe carrier and pivotally connected at a second end to the base. The lift member is also moveable along the base towards and away from the second end of the elongate door. When the lift member moves towards the second end of the elongate door, the lift member moves upwardly and arcuately for elevating the second end of the pipe carrier towards and not past the first end of the elongate door.

Without being bound by any particular theory, the aforementioned embodiments of the present disclosure may provide the benefits of a pipe carrier that is always physically constrained, or captured, at all times during the movement of the pipe carrier. The first end of the pipe carrier has a bearing surface that is in contact with the elongate door at during all movements, and it cannot move beyond the first end of the elongate door. The lift arm is also connected to the pipe carrier. The capturing of the pipe carrier during all movements may also address safety issues that can arise, as in known pipe handlers, when the pipe carrier moves beyond the second end of the elongate door towards the operational floor of the rig. This opens up the potential for the pipe carrier to be moved by accident, upwardly, backwardly or sideways, each of which can cause the control over the pipe being carried to be lost.

Further embodiments of the present disclosure relate to a pipe handling apparatus for use with an oil and gas well rig. The pipe handling apparatus comprising a base, a power section, an elongate door, a pipe carrier and a cable. The base is supportable by a first surface. The base comprises a first end and a second end and is configured to house an actuator that comprises a first shiv connected thereto. The actuator is configured to move between a contracted position and an extended position. The power section is configured to move the actuator between the contracted position and the extended position. The elongate door comprises a first end and a second end and is pivotally connected to the base at the second end. The elongate door is pivotally moveable about the second end between a collapsed position and an extended position. When the elongate door is in the extended position, the first end is positionable to abut an operational floor of a rig. The elongate door further comprises a second shiv positioned proximal the second end and a third shiv positioned proximal the first end. The pipe carrier comprises a first end and a second end and is configured to receive and support an elongate pipe. The cable is connected at a first end to the base and is connected at a second end to the carrier arm. The cable also extends about a portion of the first shiv, about a portion of the second shiv and about a portion of the third shiv. When the actuator moves towards the extended position, under control of the power section, the cable travels about at least a portion of the first shiv, at least a portion of the second shiv and at least a portion of the third shiv to cause the second end of the pipe carrier to move upwardly towards the first end of the elongate door.

Without being bound by any particular theory, the aforementioned embodiments of the present disclosure may provide the benefits of a mechanical advantage gained by having a cable that travels through one or more shivs under the power of an actuator. Furthermore, in some embodiments of the present disclosure, the power section is a hydraulic power section that is configured to hold the pipe carrier in a loaded position (i.e. not resting against another suitable support structure) without losing substantial amount of power.

Further embodiments of the present disclosure relate to a pipe handling apparatus for use with an oil and gas well rig. The pipe handling apparatus comprises a base, an elongate door, a coupler, a first actuator, a second actuator and a power section. The base is supportable by a first surface. The elongate door comprises a first end and a second end and that is pivotally connected to the base at the second end. The elongate door is pivotally moveable about the second end between a collapsed position and an extended position. When the elongate door is in the extended position, the first end is positionable to abut an operational floor of a rig. The coupler is positioned between the base and the second end. The first actuator is operatively coupled to a first end of the coupler and the elongate door. The second actuator is operatively coupled to a second end of the coupler and the base. The power section is configured to move the first actuator and the second actuator each between a contracted position and an extended position. Movement of the first actuator moves the elongate door through a first portion of between the collapsed position and the extended position and wherein movement of the second actuator moves the elongate door through a second portion of the between the collapsed position and the extended position.

Without being bound by any particular theory, the aforementioned embodiments of the present disclosure provide a mechanism for moving the elongate door by applying forces proximal the pivot point in a very controlled manner. This may be beneficial because the elongate door is very heavy and, in some embodiments it can be modular and have different lengths for use with rigs that have operational floors at different heights above the base. Modifying the length of the elongate door can change the position of the elongate door's center of gravity. As such, the combination of the first actuator, the second actuator and the coupler may provide the operator greater control over the conditions for moving the elongate door.

BRIEF DESCRIPTION OF THE DRAWINGS

FIG. 1 shows a pipe handling apparatus in a substantially collapsed position, according to embodiments of the present disclosure, wherein

FIG. 2 shows the pipe handling apparatus of FIG. 1, wherein

FIG. 3 shows further view of the pipe handler apparatus of FIG. 2, wherein

FIG. 8 is a zoomed in view of section D shown in FIG. 1, depicting a carrier assembly, according to embodiments of the present disclosure, wherein

FIG. 11 shows the pipe handling apparatus of FIG. 10, wherein

FIG. 17 shows a lift member of the pipe handling apparatus, according to embodiments of the present disclosure, wherein FIG. 17A shows a top plan view of the lift member where a collapsible extension is collapsed; FIG. 17B shows a top plan view of the lift member where the collapsible extension is not collapsed; FIG. 17C shows an isometric view of the lift member where the collapsible extension is collapsed; FIG. 17D shows an isometric view of the lift member where the collapsible extension is not collapsed; and FIG. 17E shows a zoomed in view of the collapsible extension;

DETAILED DESCRIPTION

Figure 1A:
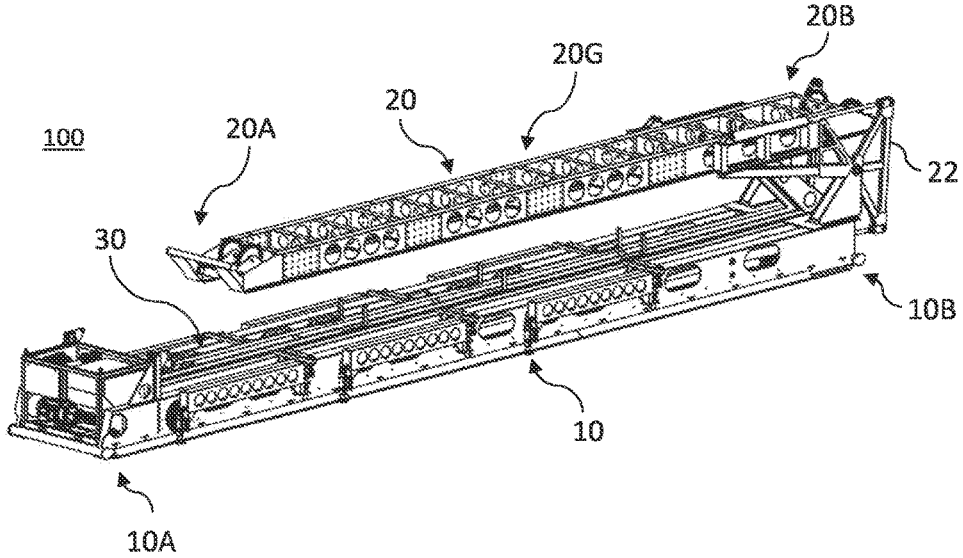
FIG. 1A is an isometric view of the pipe handling apparatus.

Embodiments of the present disclosure relate to an adjustable object handler, which is also referred to as a pipe handler assembly or a catwalk, and methods of moving objects to and from an elevated platform. The embodiments of the present disclosure may be used in the oil drilling and rigging industries, and other appropriate industries to assist with the handling of large, heavy objects, such as a wellbore tubular, which is generally referred to herein as a length of pipe. Non-limiting examples of the applicable lengths of pipe include a joint of drilling pipe, a joint of wellbore completion tubular, a joint of well-intervention tubular, a section of wellbore casing, tubular couplers and other wellbore tubulars, as appreciated by those skilled in the art. The handling of the wellbore tubular includes, but is not limited to raising and lowering the wellbore tubular from a lower position to an elevated platforms. In some embodiments of the present disclosure the elevated platform can be part of an oil and gas rig, such as a drilling rig or a completions rig (for example: a snubbing rig or a well intervention rig or as otherwise understood by those skilled in the art). The embodiments of the present disclosure may provide a mobile pipe handling apparatus that is capable of transferring at least one length of pipe from a generally horizontal storage-position below the elevated platform to a near vertical-position above the elevated platform. Some embodiments of the present disclosure relate to a modular pipe handling apparatus that can be modified, with minor adjustments, to facilitate use with elevated platforms of different heights. In some embodiments of the present disclosure, the catwalk may be automatically controlled, such that operating personnel may control the system remotely through electronically controlled systems, such as electronic motors, pneumatic systems, hydraulic systems or combinations thereof.

FIG. 1 depicts one embodiment of a pipe handling apparatus 100 according to embodiments of the present disclosure. As will be appreciated by those skilled in the art, the pipe handling apparatus 100 can be positioned adjacent an oil and gas rig, such as a drilling rig or a completions rig (not shown). The pipe handling apparatus 100 can be made of various materials provided the materials comprise the necessary strength properties to support sections of pipe that can weight upwards of 15,000 pounds. In general, the components of the pipe apparatus 100 are contrasted of metal, metal alloys or combinations thereof. In order to reduce the weight of the components of the pipe handling apparatus 100, various weight saving features may be incorporated, such as weight saving apertures throughout each component (as shown in the figures). The person skilled in the art will appreciate that components of the pipe handling apparatus 100 are generally symmetrical about the midline. As such, the discussion below will generally describe one side of each component with the understanding that such a description is equally applicable to the opposite side of the component being described, unless otherwise indicated herein below.

Figure 1B:
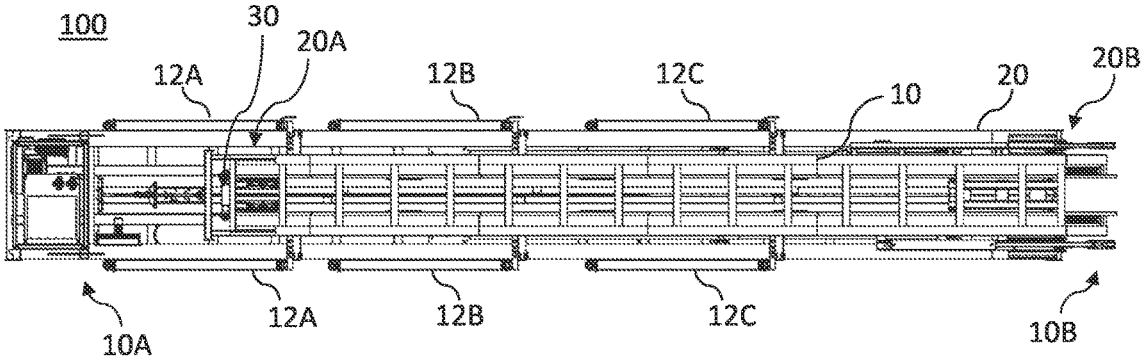
FIG. 1B is a top plan view of the pipe handling apparatus; and, FIG. 1C is a side elevation view of the pipe handling apparatus.
Figure 1C:
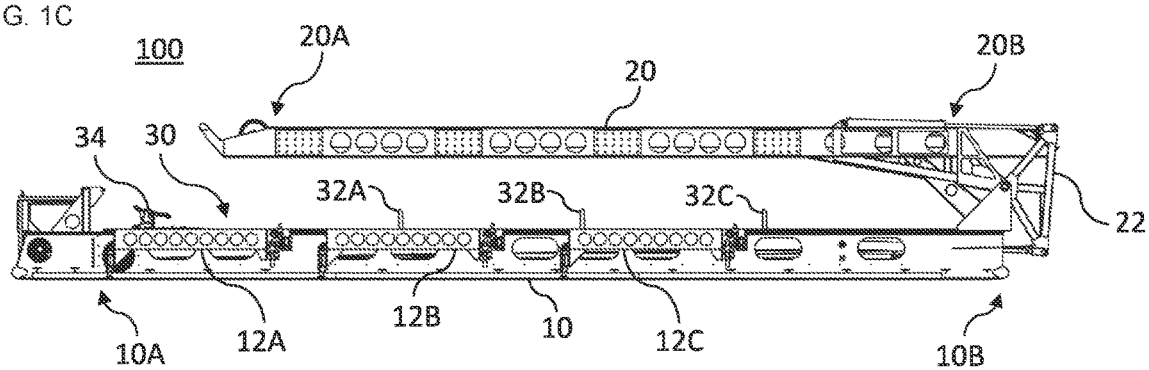
Figure 2A:
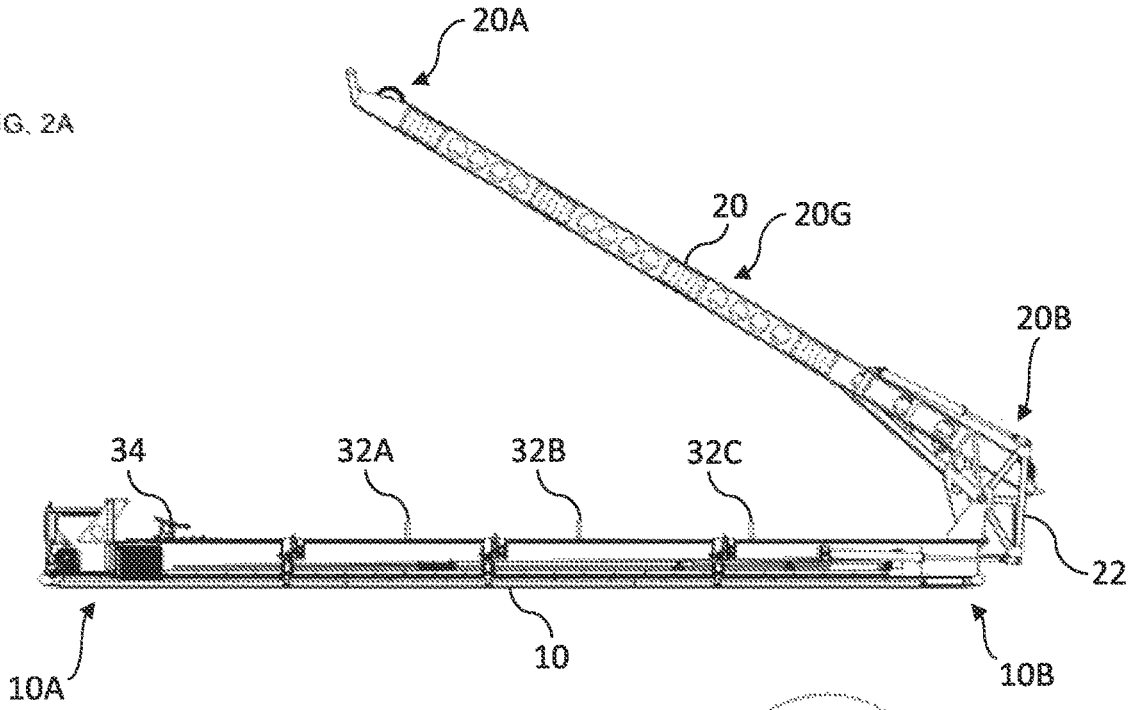
FIG. 2A shows a side elevation view of the pipe handler apparatus in a first intermediate position; and, FIG. 2B shows an isometric view of the pipe handler apparatus in a second intermediate position with sections A, B, C, D and E of the pipe handling apparatus identified.
Figure 2B:
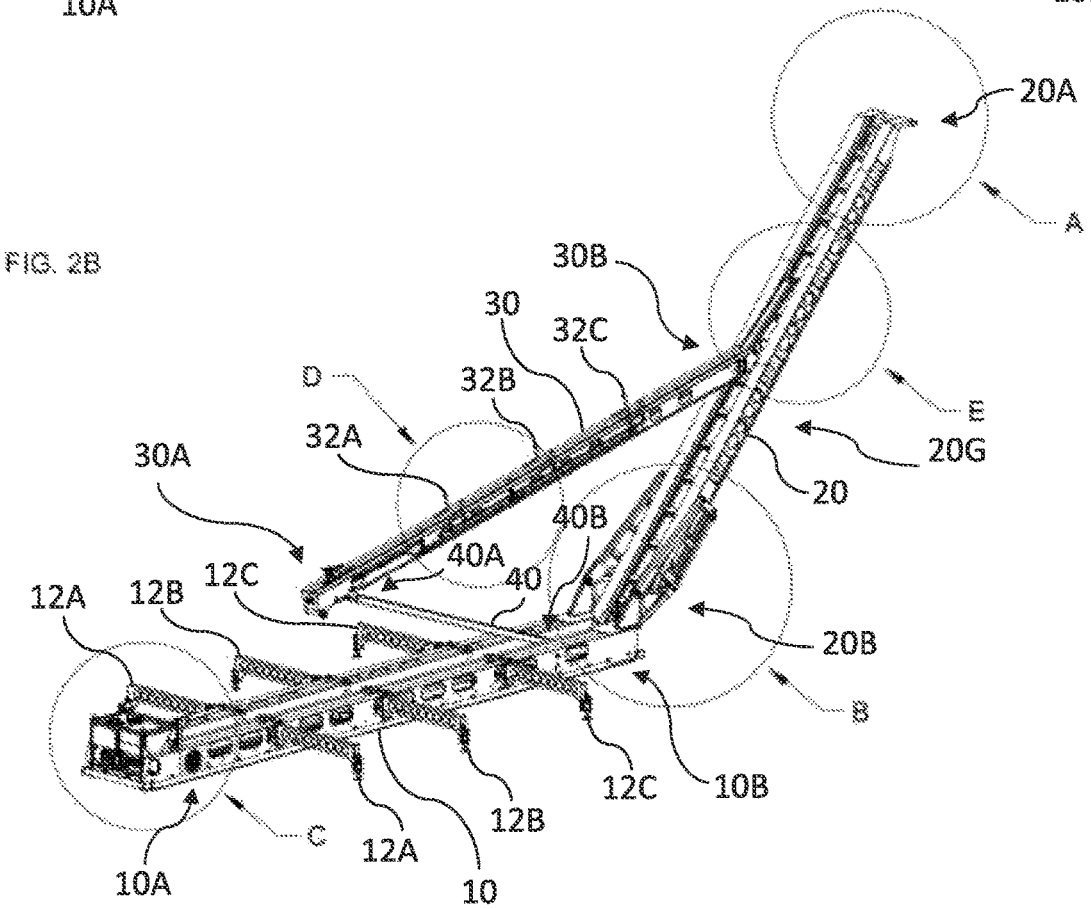

As shown at least in FIG. 1A, FIG. 1B and FIG. 1C, the apparatus 100 comprises the components of a base 10, an elongate door 20, a pipe carrier 30 and a lift assembly 40 (shown in FIG. 2*b*). The pipe handling apparatus 100 can move between a collapsed position (FIG. 1), one or more intermediate positions (as shown at least in FIG. 2 and FIG. 3) and an extended position (as shown at least in FIG. 10 and FIG. 11). As utilized herein, the term "stroke" refers to a partial or complete movement of one or more components of the pipe handling apparatus 100 with respect to another component. For example, as the pipe handling apparatus moves from the collapsed position, the elongate door 20 pivotally moves through a portion of a stroke to one or more intermediate positions (compare FIG. 1 with FIG. 2) and through a further portion of the stroke from the intermediate position to the extended position (compared FIG. 2 with FIG. 3). As the components of the pipe handling apparatus 100 move through various positions, a length of pipe (not shown) can be moved from a substantially horizontal position upon the pipe carrier 30 proximal to the base 10 to the fully extended position (as shown at least in FIG. 10 and FIG. 11). When the length of pipe is moved from the substantially horizontal position proximal to the base 10, as the pipe handling apparatus 100 moves through to the extended position, the length of pipe is moved upwardly to become proximal to an upper operational floor of a rig (not shown). From this position, the length of pipe is moved by further components of the rig (not shown) to occupy a substantially vertical position for insertion into the wellbore below rig (not shown). As will be appreciated by those skilled in the art, the movement and functions of the pipe handling apparatus 100 can be operated in reverse so as to lower the length of pipe from the elevated position upon the pipe carrier 30 (when the pipe handling apparatus 100 is in the extended position) to a substantially horizontal position proximal to the base 10. While the discussion below describes the movement of the pipe handling apparatus 100 from the collapsed position to the extended position, for moving the length of pipe from the substantially horizontal position to proximal to the operational floor of the rig, the person skilled in the art will appreciate the reverse movements of the pipe handling apparatus 100.

The base 10 can be supported directly on a surface (not shown) such as the ground or a lower floor of the rig. The base 10 defines a first end 10A and a second end 10B, which together define a longitudinal axis of the base 10. In some embodiments of the present disclosure the base 10 may be elongate along the longitudinal axis; however, this is not necessary. The base 10 is configured to receive a length of pipe. The base 10 comprises at least one pipe rack arm 12. The non-limiting example shown in FIG. 1 depicts three arms 12A, 12B and 12C; however, more or less pipe rack arms 12 may be utilized. The pipe rack arms 12 are configured to cooperate with a pipe indexer system to receive a length of pipe, typically from a longitudinal side of the base 10 and to direct the length of pipe to rest upon the pipe carrier 30.

As shown at least in FIG. 1A and FIG. 1C, the base 10 can be operatively coupled to and spport the elongate door 20 by at least by a coupler 22, for example a triangle linker. The elongate door 20, which can also be referred to as a V door, has a first end 20A and a second end 20B, together which define an elongate longitudinal axis of the elongate door 20. As shown at least FIG. 1A, the elongate door 20 has an intermediate section 20G between the first end 20A and the second end 20B. The intermediate section 20G may have a first length, and may be removable and replaceable with a second, different intermediate section 20G having a second, different length.

Figure 3A:
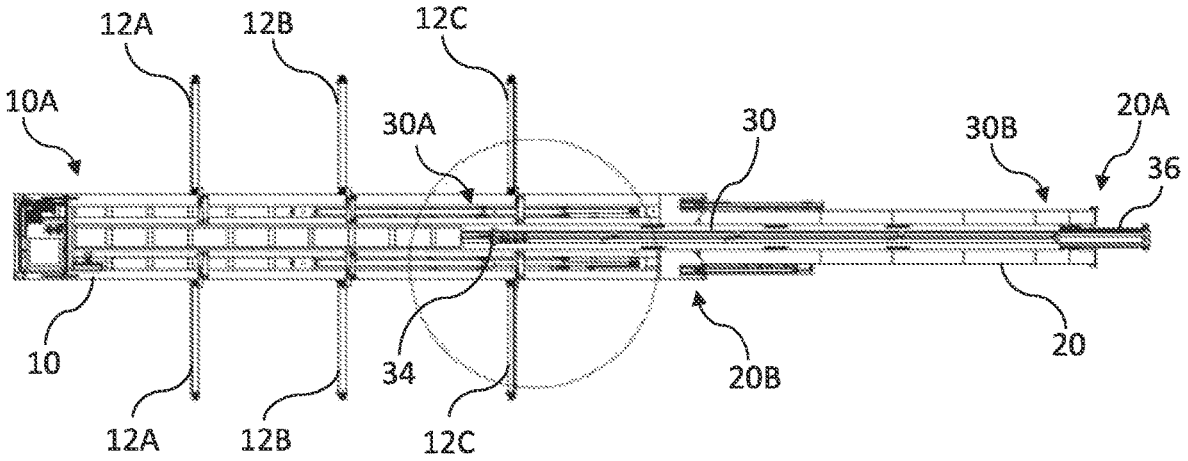
FIG. 3A is a top plan view of the pipe handling apparatus.
Figure 3B:
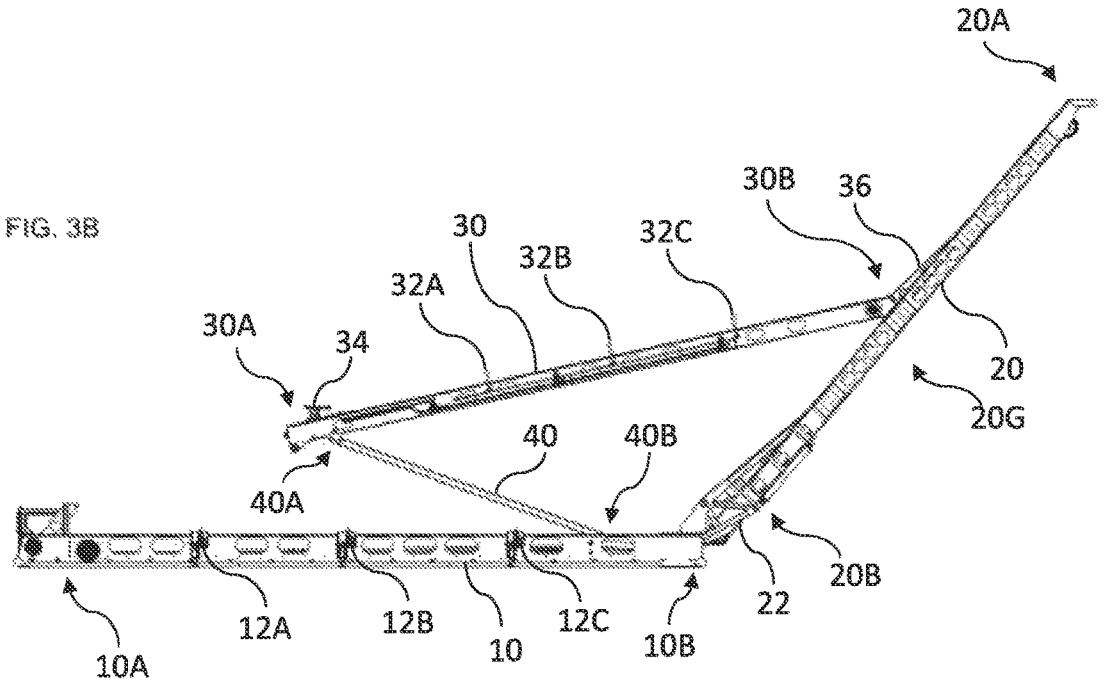
FIG. 3B is a side-elevation view of the pipe handling apparatus.

FIG. 2A shows the elongate door 20 in a first intermediate position which it occupies by a pivoting movement about a pivot assembly 21 (shown at least in in FIG. 7) that is positioned between the second end 10B of the base 10 and the second end 20B of the elongate door 20. FIG. 2B shows the elongate door 20 in a fully extended position where the first end 20B is positionable to abut a portion of the upper operational floor of the rig. Also shown in FIG. 2B, the pipe carrier 30 has begun to move along the elongate door 20, as described further below. As shown in FIG. 2B the lift member 40 is supporting underneath the pipe carrier 30. FIG. 3A and FIG. 3B show different views of the pipe assembly 100 with the elongate door 20 in the extended position and the pipe carrier 30 and the lift member 40 in an intermediate position. As will be described herein further below, an actuator, shiv and cable system may be used to move the pipe carrier 30 towards and away from the first end 20A of the elongate door 20. As this occurs, the lift member 40 supports the pipe carrier 30 from below.

As shown at least in FIG. 2B, the pipe carrier 30 comprises a first end 30A and a second end 30B, which together define a longitudinal axis of the pipe carrier 30. The pipe carrier 30 may also comprise a skate assembly 34 that is positioned proximal to the first end 30A of the pipe carrier 30. As will be appreciated by the person skilled in the art, the skate assembly 34 can slidably move along the longitudinal axis of the pipe carrier 30 and it is configured to receive and releasably secure an end of the length of pipe. The skate assembly 34 may restrict longitudinal movement of the length of pipe as is it moved upon the pipe carrier from proximal to the base 10 to proximal to the first end 20A of the elongate door 20 in the extended position.

Figure 4:
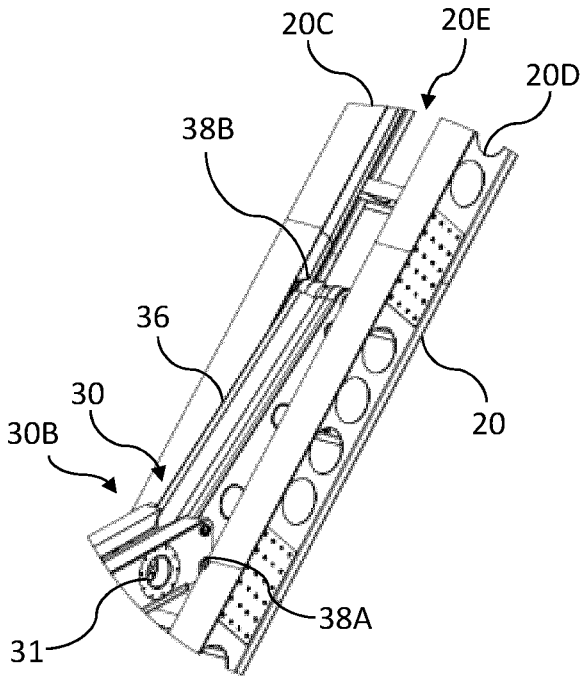
FIG. 4 is a zoomed in view of section E shown in FIG. 2, depicting a middle section of a V-door base, according to embodiments of the present disclosure.

As shown in FIG. 4, the elongate door 20 may be constructed to two bodies 20C and 20D that are connected to each other by cross members (not shown) and that define a guide channel 20E therebetween. The guide channel 20E may further comprise a floor that is defined by cross-members that extend between interior, lateral walls of the bodies 20C and 20D. The guide channel 20E is configured to receive a portion of the pipe carrier 30 therein and to restrict lateral movement of the pipe carrier 30 as the pipe carrier 30 moves along (upwardly or downwardly) the elongated door 20.

Figure 19:
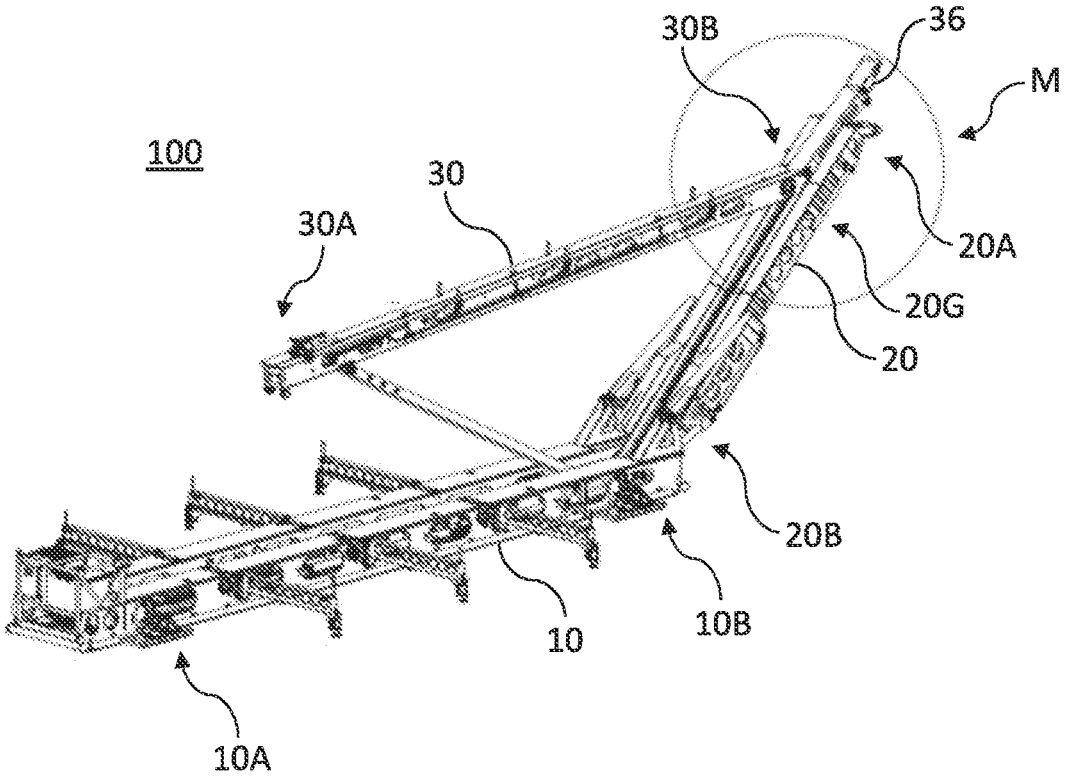
FIG. 19 is an isometric view of the pipe handling apparatus, according to embodiments of the present disclosure, where the pipe carrier is proximal to a first end of the elongate door, with section M of the pipe handling apparatus identified.
Figure 20:
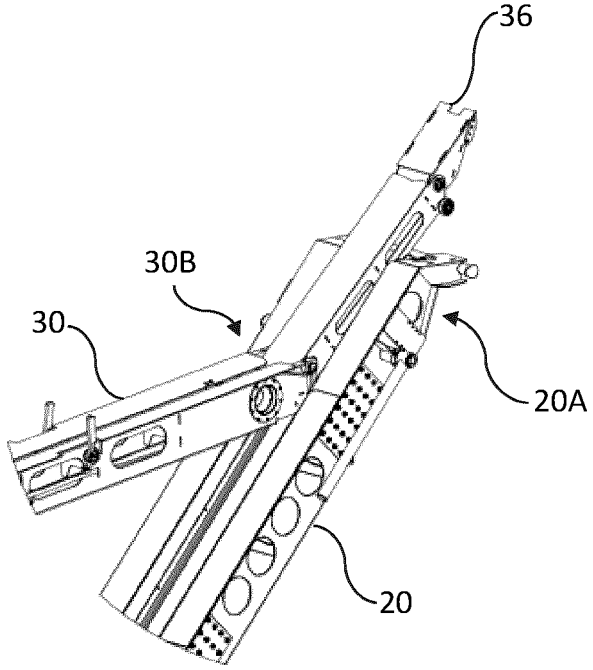
FIG. 20 is a zoomed in view of section M of the pipe handling apparatus as identified in FIG. 19, according to embodiments of the present disclosure, where the pipe carrier is proximal to the first end of the elongate door.

As shown in FIG. 4, the second end 30B of the pipe carrier 30 comprises a first bearing surface 38A that is positioned to bear against at least the floor of the guide channel 20E when the pipe carrier 30 is moving along the elongate door 20. In some embodiments of the present disclosure the bearing surface 38A may include one or more rotatable members, such as wheels or rollers, to facilitate movement of the pipe carrier 30 along the guide channel 20E. Also a shown in FIG. 4, the pipe carrier 30 may further comprise a carrier extension 36 that extends from the second end 30B of the pipe carrier 30. In some embodiments of the present disclosure the carrier extension 36 may be pivotally connected to the second end 30B, for example at a pivot point 31. In some embodiments of the present disclosure, the carrier extension 36 may comprise a second bearing surface 38B that are positioned to bear against at least the floor of the guide channel 20E when the pipe carrier 30 is moving along the elongate door 20. In some embodiments of the present disclosure, the second bearing surface 38B may include one or more rotatable members, such as wheels or rollers, to facilitate movement of the pipe carrier 30 along the guide channel 20E. FIG. 19 shows the second end of the pipe carrier 30 with the carrier extender 36 acting as the second bearing surface 38B when the pipe carrier 30 is captured within the carrier groove 20E proximal the first end 20A of the elongate door 20. FIG. 20 shows a zoomed view of section M in FIG. 19.

Figure 21:
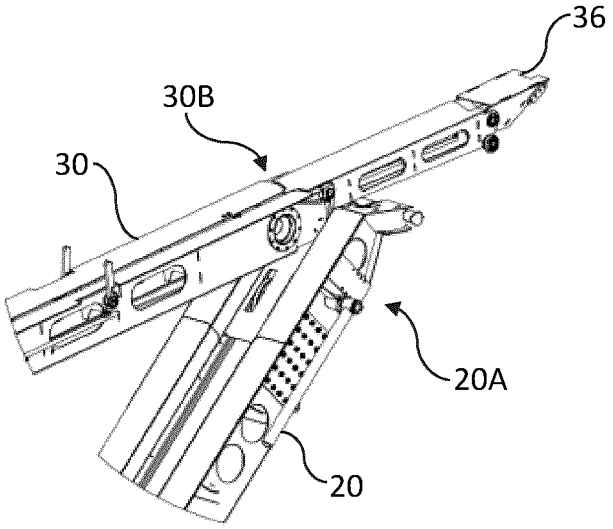
FIG. 21 is shows the pipe carrier of FIG. 20 at the first end of the elongate door.
Figure 22:
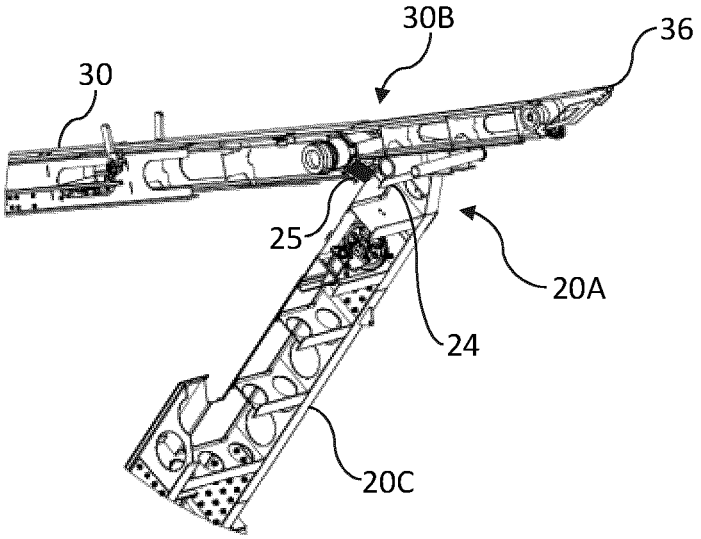
FIG. 22 is a partial cut-away section of FIG. 21 that depicts a stop that is defined between the pipe carrier and the elongate door when the pipe carrier is at the first end of the elongate door.
Figure 23:
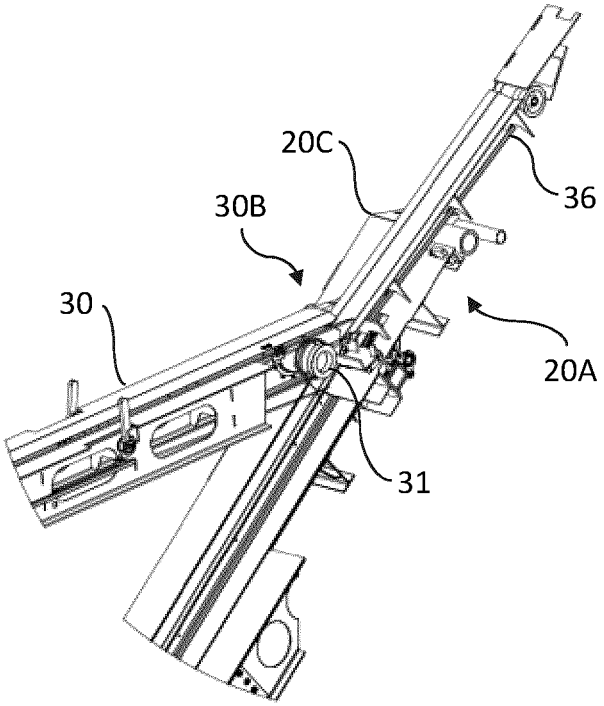
FIG. 23 is a partial cut-away section of FIG. 20.

FIG. 21 shows the pipe carrier 30 held at and not past the first end 10A of the elongate door 20 with the carrier extension 36 no longer bearing against the elongate door 20. Furthermore, the first bearing surface 38A is abutting a portion of the first end 20A of the elongate door 20. FIG. 21 and FIG. 22 are partial cut away views of FIGS. 19 and 20, respectively. FIG. 22 shows the second shoulder 25 of the pipe carrier 30 abutting the first shoulder 24 of the elongate door 20 for preventing further movement of the pipe carrier 20 beyond the first end 20A of the elongate door 20. FIG. 23 shows the pivot point 31 about which the carrier extension 36 may pivot relative to the second end 30B of the pipe carrier 30.

Figure 5:
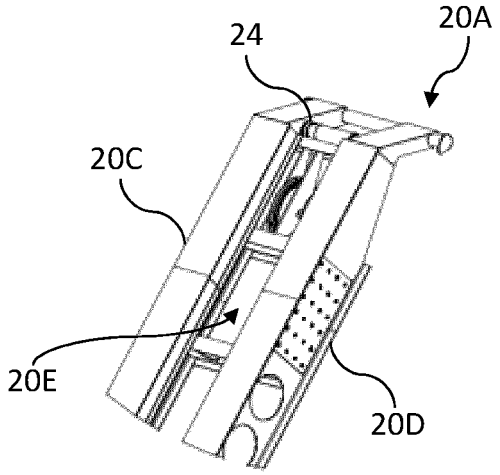
FIG. 5 is a zoomed in view of section A shown in FIG. 1, depicting a top sheave section of the V-door base, according to embodiments of the present disclosure.

FIG. 5 shows the first end 20A of the elongate door 20 as comprising a first shoulder 24. As will be discussed further below, the first should 24 can cooperate with a second shoulder 25 to act as a stop and to maintain capture of the pipe carrier 30 within the guide channel 25E (see FIG. 22).

Figure 6:
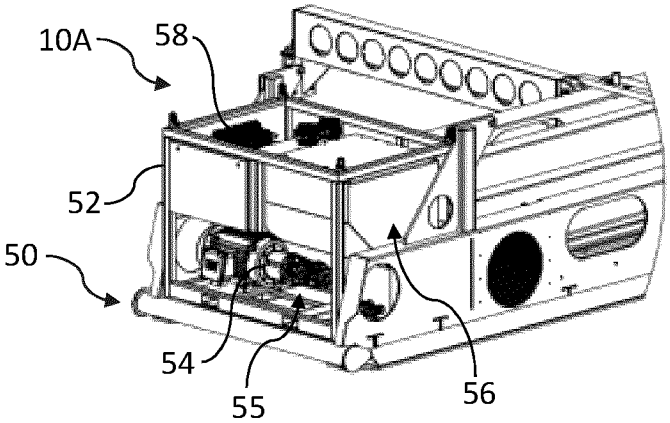
FIG. 6 is a zoomed in view of section C shown in FIG. 1, depicting a power unit of the pipe handling apparatus, according to embodiments of the present disclosure.

As shown in FIG. 6, some embodiments of the present disclosure, the first end 10A of the base 10 is configured to house a power system 50. The power section 50 is configured to receive input commands from an operator and to translate those commands into sending move commands to various components of the pipe handler apparatus 100. The user commands may be in the form of electronic signals that are translated into move commands by a controller unit 52. In some embodiments of the present disclosure the controller unit 52 can translate the electronic command signals from the user into hydraulic commands that are communicated through one or more hydraulic circuits of the pipe handler apparatus 100. For example the power system 50 may further comprise a motor 54 that is operatively connected to a hydraulic drive unit 55. The hydraulic drive unit 55 is in fluid communication with a reservoir 56 of hydraulic fluid that the hydraulic drive unit 55 can control the flow of the hydraulic fluid to and from the reservoir 56 by controlling the position of one or more hydraulic valves 58. As will be appreciated by those skilled in the art, the power system 50 can operate in a similar fashion as known programmable logic controller controlled hydraulic drive systems. Examples of some components that can be moved by the power system 50 include: pivoting the elongate door 20 about the pivot system 21; the safety bars 32; the pipe rack arms 12, the components of the pipe kicker system and the actuator, shiv and cable system (as described further herein below).

Figure 7:
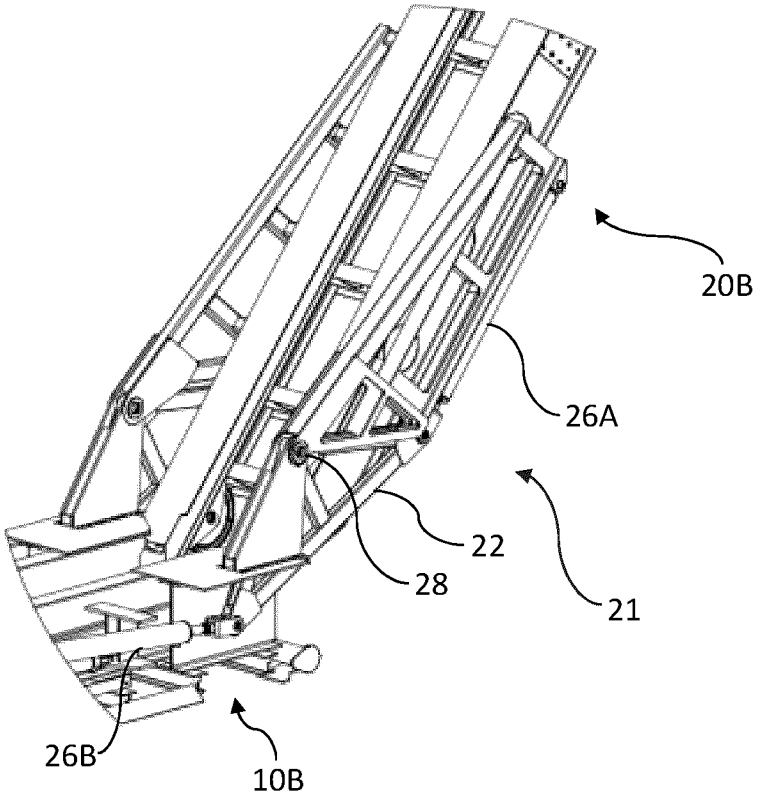
FIG. 7 is a zoomed in view of section B shown in FIG. 1, depicting a pivot assembly of the V-door base, according to embodiments of the present disclosure.

As shown in FIG. 7, the pivoting movement of the elongate member 20 relative to the second end 10B of the base 10 is due to the action of the pivot assembly 21 that comprises a pivot point 28, one or more first actuators 26A, such as one or more hydraulic cylinders, that bear against a portion of the second end 20B of the elongate door 20 and the coupler 22 and one or more second actuators 26B, such as one or more hydraulic cylinders, that bear against a portion of the second end 10B of the base 10 and the coupler 22. Either of the first actuator 26A or the second actuator 26B can extend to provide a first portion of a stroke to move the elongate door 20 from the collapsed position. The other actuator (i.e. either the second actuator 26B or the first actuator 26A, as the case may be) may then extend to provide the second portion of the stroke to move the elongate door from an intermediate position to the fully extended position. During the first portion and second portion of this stroke the second end 20B of the elongate door 20 pivots relative to the second end 10B of the base, about the pivot point 28. The pivot point 28 can comprise a pivot connector, such as a pin, that fits within components defined of both the base 10 and the elongate door 20 for pivotably coupling (which may also be referred to as pivotally connecting) the base 10 and the elongate door 20.

Figure 8A:
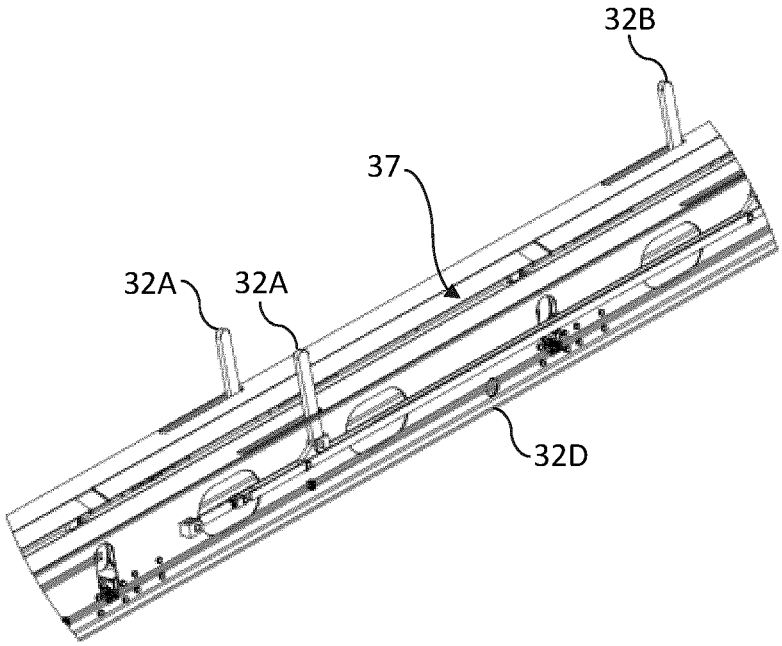
FIG. 8A shows the carrier assembly with safety bars on both sides of the carrier assembly in an extended position; and, FIG. 8B shows the carrier bars on one side of the carrier assembly pivotally retracted.
Figure 8B:
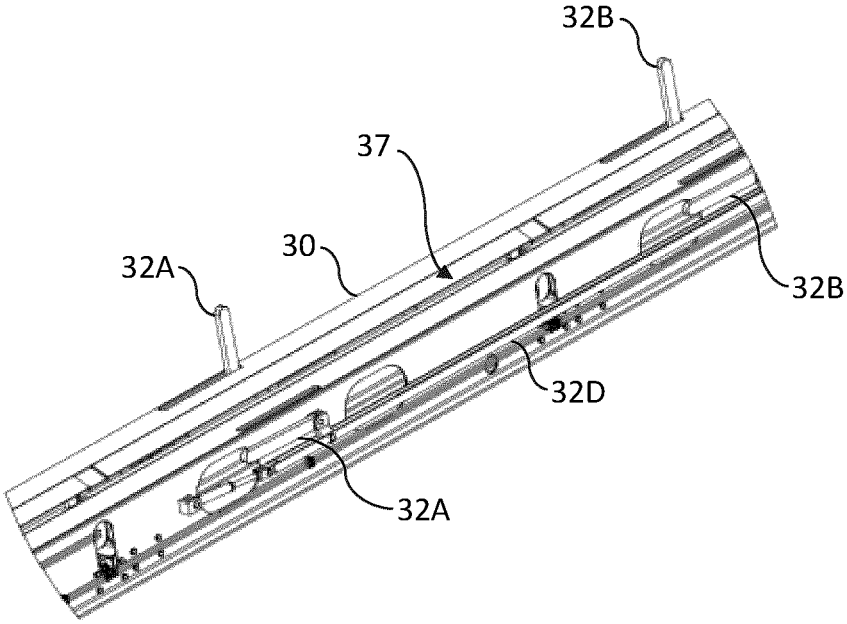

FIG. 8A shows the safety bars 32A and 32B on either side of the pipe carrier 30 and the pipe carrying groove 37. The pipe carrying groove 37, the safety bars 32A, 32B and the skate assembly 34 cooperate to restrict movement of the length of pipe that is being carried upon the pipe carrier 30. The pipe carrier 30 may further comprise a safety bar link 32D that operatively links the rotation of the safety bars 32A, 32B on the same side of the pipe carrying groove 37 to allow the entry or exit of the length of pipe onto or from the pipe carrier 30 on either side. For example FIG. 8B shows the safety bars 32A, 32B as being rotated into a non-extended position.

Figure 9:
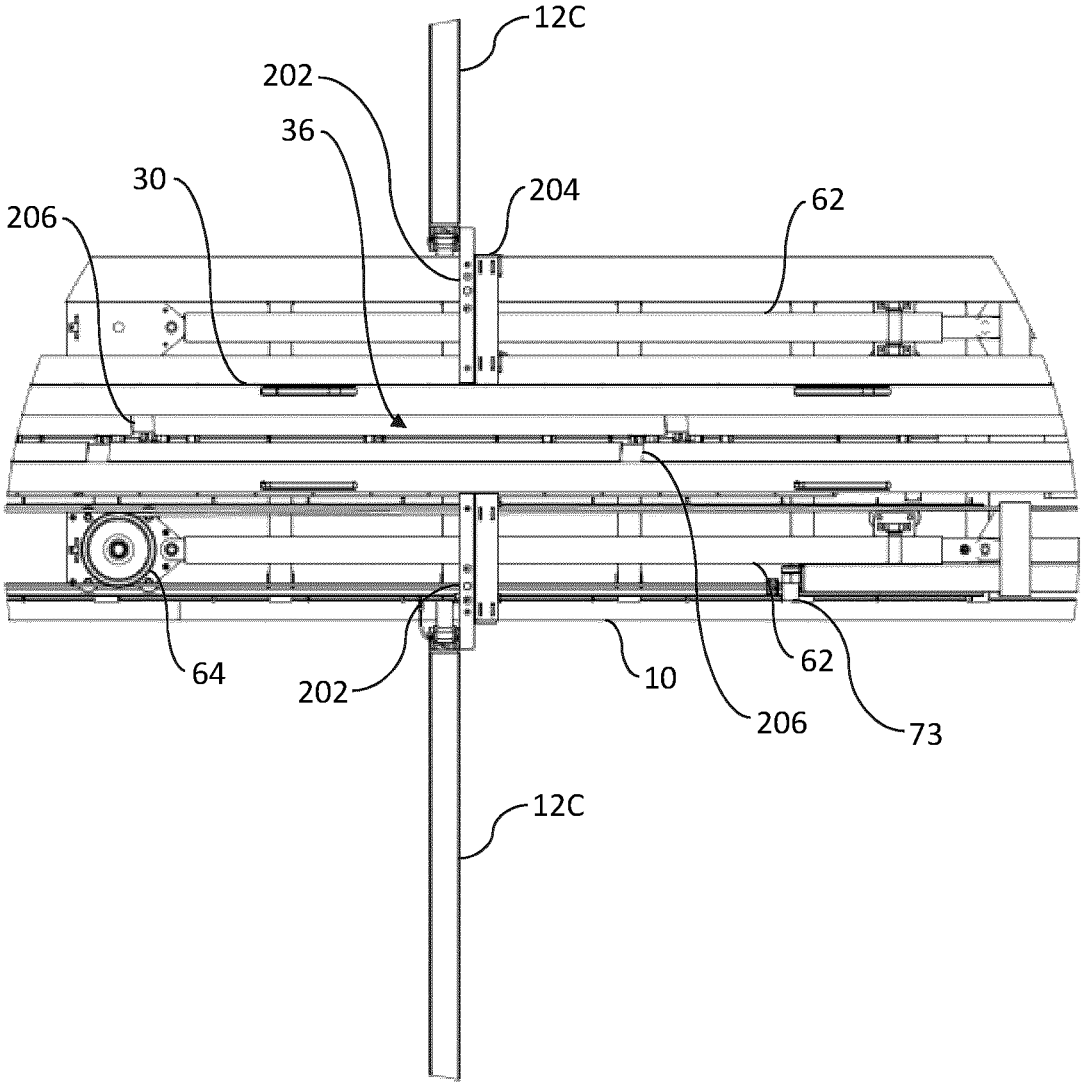
FIG. 9 is a zoomed in view of section F shown in FIG. 2, depicting a carrier lift assembly, according to embodiments of the present disclosure.

As shown in FIG. 9 and as will be appreciated by those skilled in the art, the pipe kicker system may comprise one or more pipe index stop pins 202, one or more pipe indexers 204 and one or more pipe kickers 206 (as shown in FIG. 9). The pipe kicker system is configured to control the movement of the length of pipe on to the pipe carrier 30 to reside within a pipe carrier groove 37 of the pipe carrier 30. As shown at least in FIG. 1C, the pipe carrier 30 can include at least one pair of safety bars 32, with three pairs of safety bars 32A, 32B and 32C shown. As will be discussed further below, the safety bars 32 are rotatably coupled to each side of the pipe carrier 30 and when rotated into the extended position the safety bars 32 are configured to restrict or reduce lateral movement of the length of pipe when being moved upon the pipe carrier 30. For example, the safety bars 32 may help maintain a position of the length of pipe within the pipe carrying groove 37.

Figure 10:
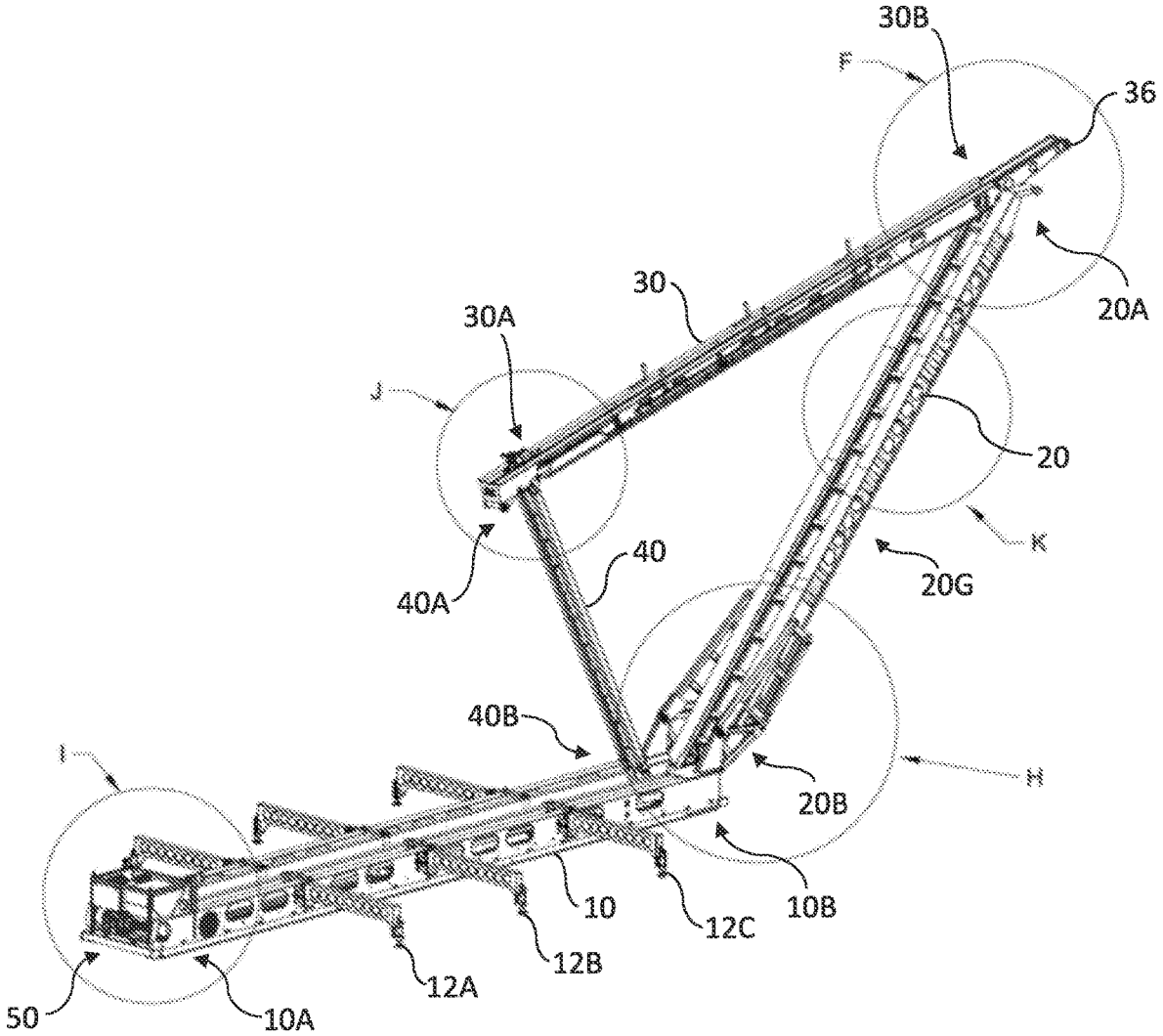
FIG. 10 shows the pipe handling apparatus of FIG. 1 in a substantially extended position, according to embodiments of the present disclosure, with sections F, H, I, J, and K of the pipe handling apparatus identified.
Figure 11A:
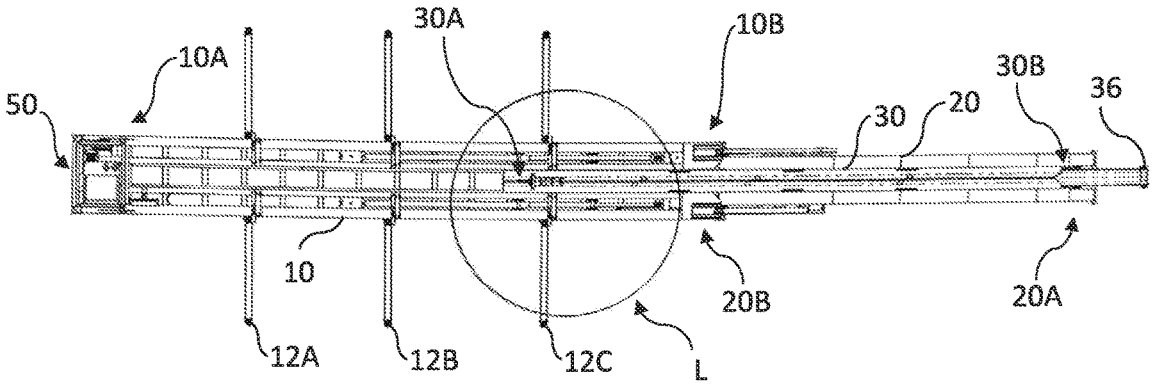
FIG. 11A is a top plan view of the pipe handling apparatus; and, FIG. 11B is a side elevation view of the pipe handling apparatus.
Figure 11B:
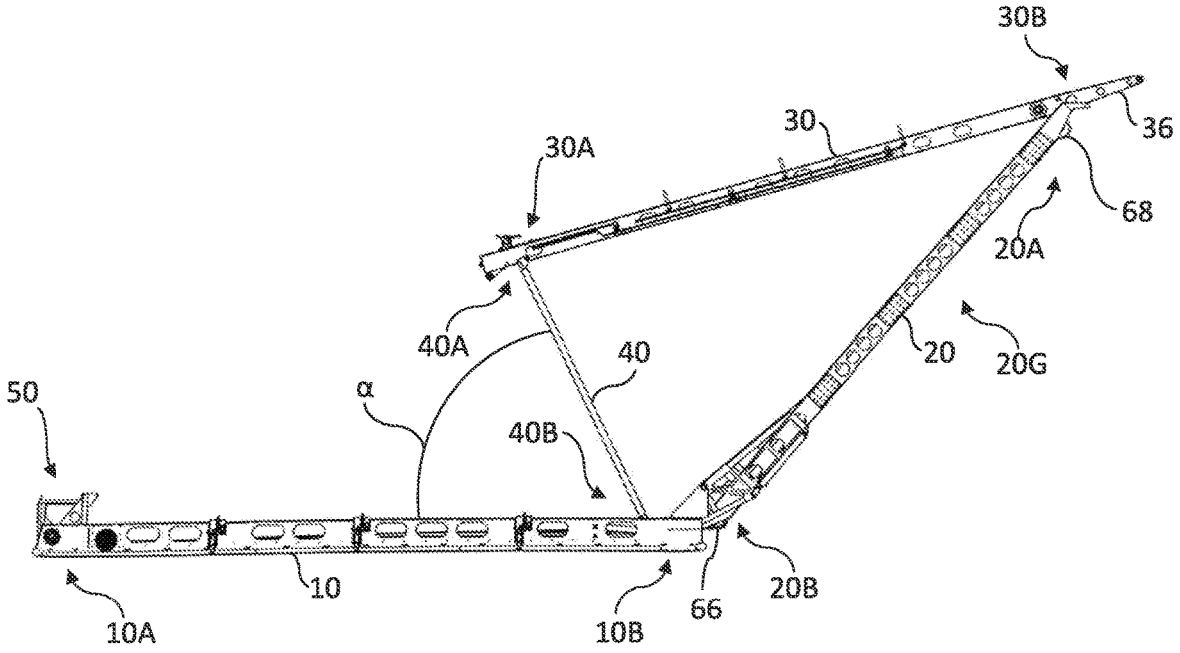

FIG. 10 shows the pipe handing apparatus 100 in the extended position, where the elongate door 20 is in the extended position and the pipe carrier 30 is held in the carrier groove 20E at the first end 20A of the elongate door 20 and the carrier extension 36 is extending past the first end 20A of the elongate door 20. FIG. 11A shows a top plan view of the pipe handling apparatus 100 in the extended position and FIG. 11B shows a side elevation view of the pipe handling apparatus 100 in the extended position. As shown in at least FIG. 11B, the elongate door 20 has the intermediate section 20G between the first end 20A and the second end 20B. The intermediate section 20G may have a firth length, and may be removable and replaceable with a second, different intermediate section 20G having a second, different legnth.

Figure 12:
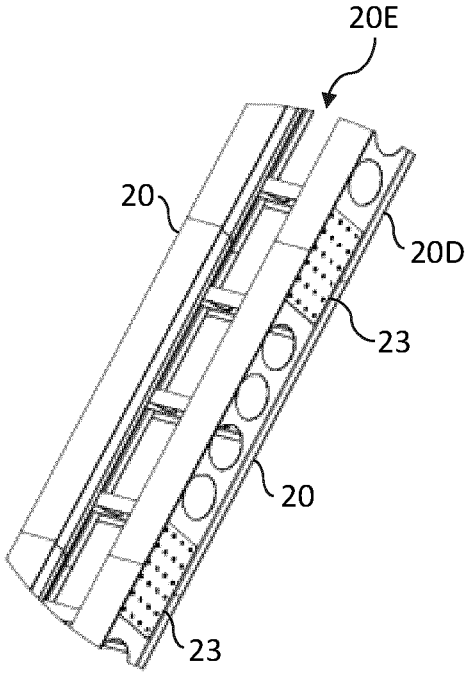
FIG. 12 is a zoomed in view of section K shown in FIG. 10, depicting a V-door middle section, according to embodiments of the present disclosure.
Figure 26:
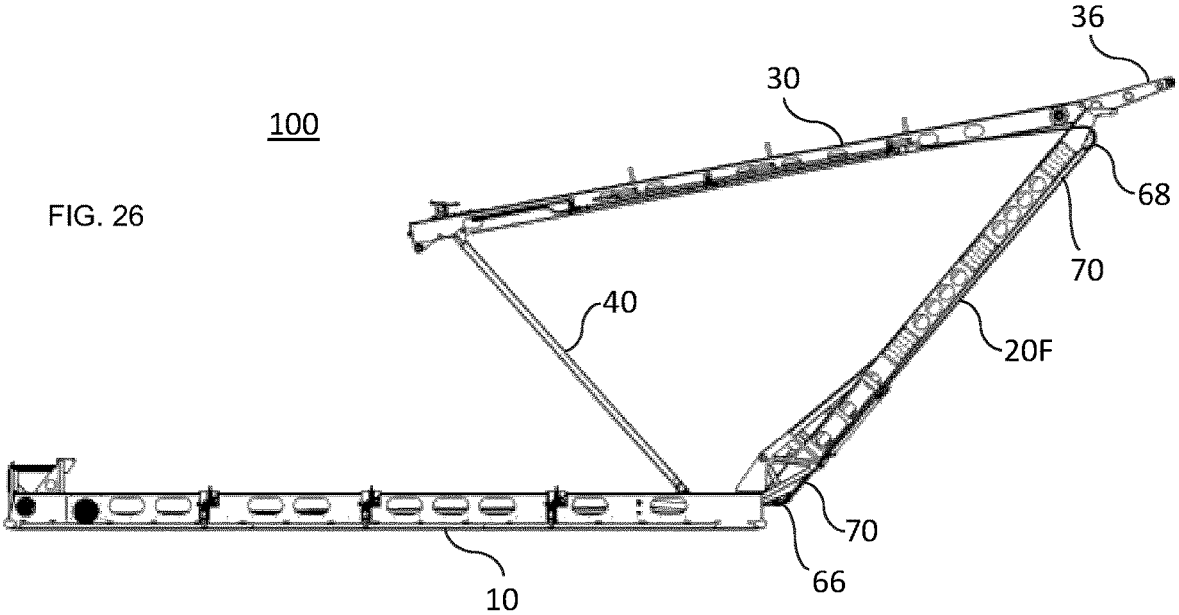
FIG. 26 shows a side plan view of a pipe handler apparatus, according to embodiments of the present disclosure, where the elongate door has been shortened to accommodate use with rigs that have lower operational floors.

FIG. 12 shows a section of the elongate door 20 that, according to some embodiments of the present disclosure, includes one or more connector plates 23. The connector plates 23 are configured to releasably receive one or more connectors therethrough, for example bolts, for securing different longitudinal sections of the elongate door 20 together. The connector plates 23 may allow the length of the elongate door 20 to be changed so that the pipe handler apparatus 100 is modular and can be used with rigs that have different operational floor heights. FIG. 26 shows one non-limiting embodiment of an elongate door 20F that has less connector plates 23 and, therefore, is shorter than the elongate door 20 shown in the other figures.

Figure 13:
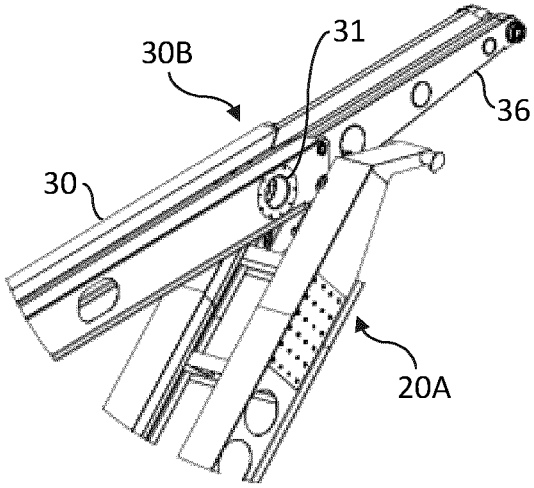
FIG. 13 is a zoomed in view of section F shown in FIG. 10, depicting a top sheave section of the V-door base and a carrier extension, according to embodiments of the present disclosure.

FIG. 13 shows the second end 30B of the pipe carrier 30 as being captured within the carrier groove 20E of the elongate door 20 at the first end 20A thereof. In this position, the carrier extension 36 can extend towards the operational floor of the rig to facilitate the movement of the length of pipe from the pipe carrier to and from the operational floor. In some embodiments of the present disclosure, the first bearing surface 38A of the pipe carrier 30 is held at and not past the first end 20A of the elongate door 20. This is one manner by which the pipe carrier 30 is captured during all movements between the collapsed position and the extended position, and vice versa.

Figure 14:
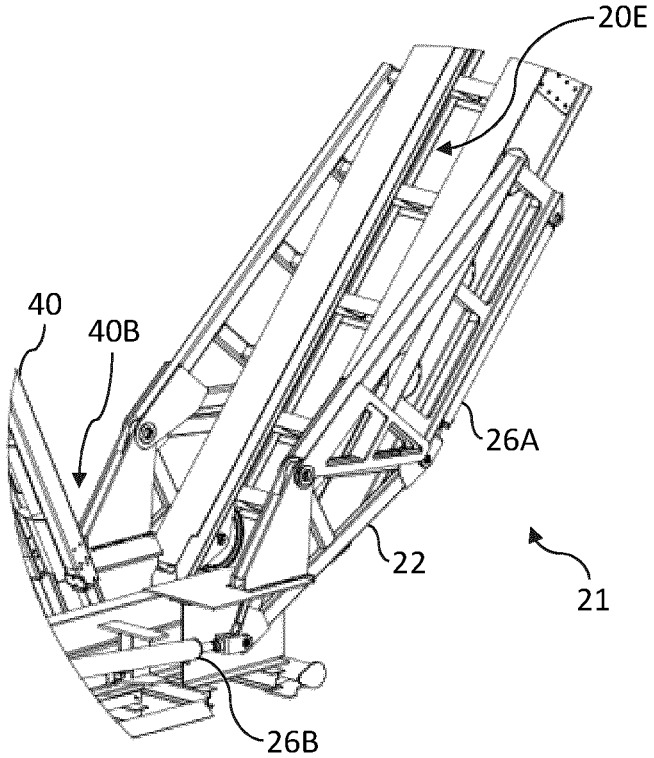
FIG. 14 is a zoomed in view of section I shown in FIG. 10, depicting a power unit of the pipe handling apparatus, according to embodiments of the present disclosure.

FIG. 14 shows the pivot assembly 21 and the second end 40B of the lift member 40 after the first end 40A of the lift member 40 has moved pivotally and arcuately to support beneath the pipe carrier 30.

Figure 15:
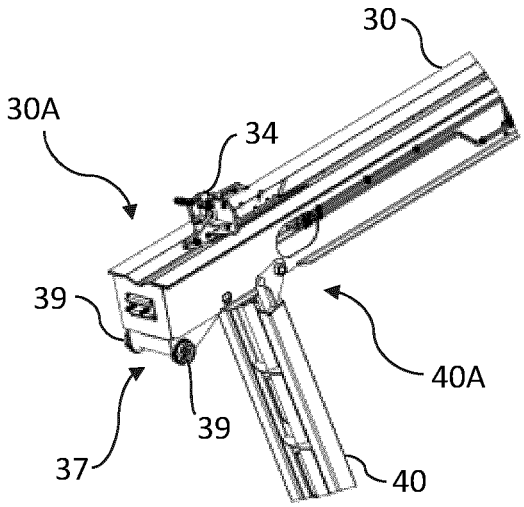
FIG. 15 is a zoomed in view of section H shown in FIG. 10, depicting a rotation assembly of the V-door base, according to embodiments of the present disclosure.

FIG. 15 shows the first end of the pipe carrier 30A as comprising a third bearing surface 37. The third bearing surface 37 bears against a portion of the base 10 as the pipe carrier 30A initiates its movement along the carrier groove 20E or as it completes its movement into the collapsed position. In some embodiments of the present disclosure the third bearing surface 37 comprises one or more rotatable members 39, such as one or more wheels or rollers.

As shown at least in FIG. 17, the lift member 40 has a first end 40A and a second end 40B, which together define a longitudinal axis of the lift member 40. The lift member 40 is slidably and rotatably moveable within the base 10. The first end 40A of the lift member 40 is pivotally connected proximal to the first end 30A of the pipe coupler 30. The second end 40B of the lift member 40 is pivotally connected to the base 10, proximal to the second end 10B. In some embodiments of the present disclosure, the lift member 40 may comprise an extension 43 (which is shown in FIG. 17). In some embodiments of the present disclosure, the extension 43 extends past the second end 40A of the lift arm 40 to pivotally connect with a portion of the base 10, or a portion of the second end of the elongate arm 20B, or both. The extension 43 may be reversibly collapsible to allow for the lift member 40 to advance and retract away from the second end of the base 10B while the second end 40B of the lift member 40 is held in position by the pivotable connection of the extension 43. In operation, as the pipe carrier 30 moves upwardly along the elongate door 20, the lift member 40 slidably moves towards the second end 10B of the base 10 and this causes the extension to collapse, thus shortening the overall length of the lift member 40. When the lift member 40 has travelled as far as it can along the base 10 towards the second end 10B, for example because there is no further play to collapse, then the second end of the lift assembly 40B forms a pivot point with the second end 10B or the second end 20B. As shown in FIG. 17E, the extension 43 may define a shoulder 45 that prevents further collapsing of the lift member 40. In some embodiments of the present disclosure, the lift member 40 and the extension 44 are arranged in a nested configuration so that when the lift member 44 slides towards the second end of the elongate door, at least a portion of the extension 44 is received within the second end 40B, or vice versa. In other words, the extension 44 and the second end 40B may be in a telescopic arrangement to allow the lift member 40 to be reversibly collapsible. However, as will be appreciated by those skilled in the art, other mechanisms or materials can be employed to provide the reversible collapsibility of the lift member 40.

Because the first end of the lift member 40A is pivotally connected to the first end 30A of the pipe carrier 40, the first end of the lift member 40A is lifted upwardly, in a pivoting and arcuate fashion to a position that supports the pipe carrier 30 when it is held in the extended position. This is another manner by which embodiments of the present may provide full capture of the pipe carrier 30 as it moves up and down the elongate door 20. Furthermore, when the pipe carrier 30 is held at and not past the first end 20A, the longitudinal axis of the lift member 40 can be at an angle $\alpha$ that is less than 90 degrees (i.e. less than vertical), which may also contribute towards the capture of the of pipe carrier 30 within the carrier groove 20E (FIG. 11B).

Figure 16:
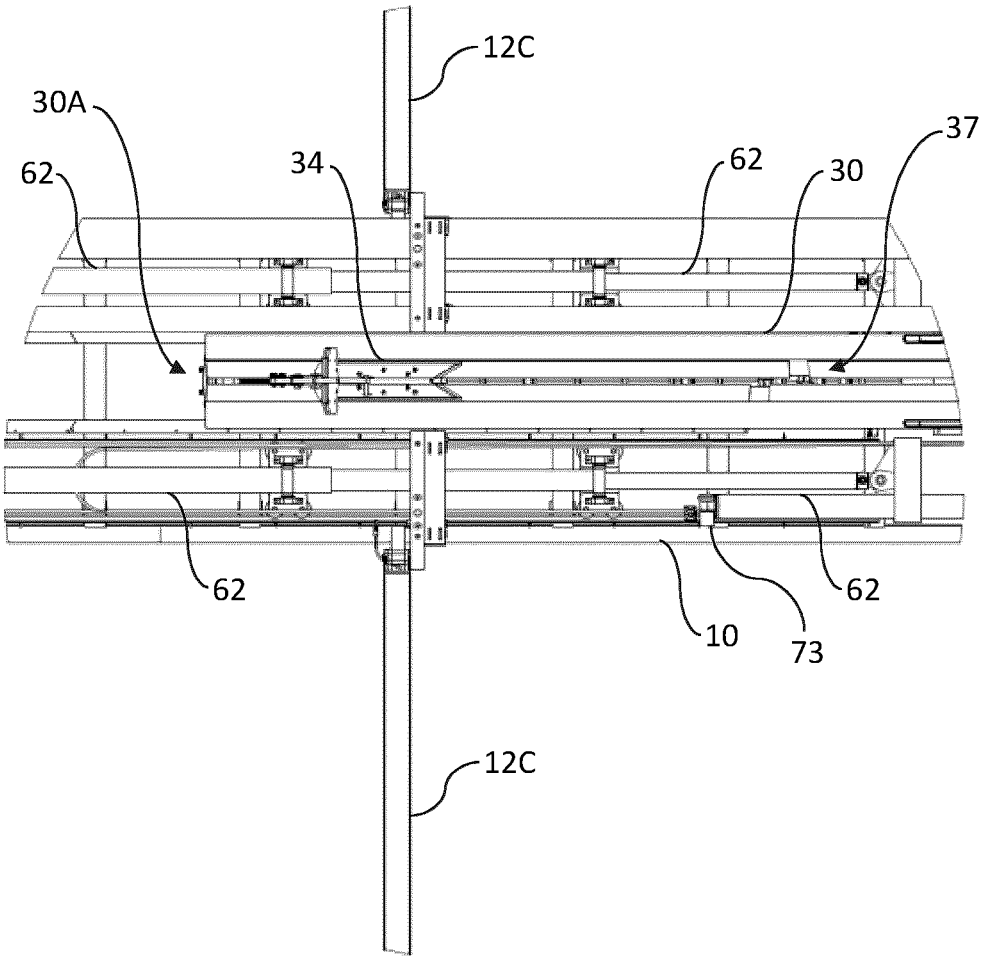
FIG. 16 is a zoomed in view of section L shown in FIG. 11A, depicting a carrier lift assembly of the pipe handling apparatus, according to embodiments of the present disclosure.
Figure 18:
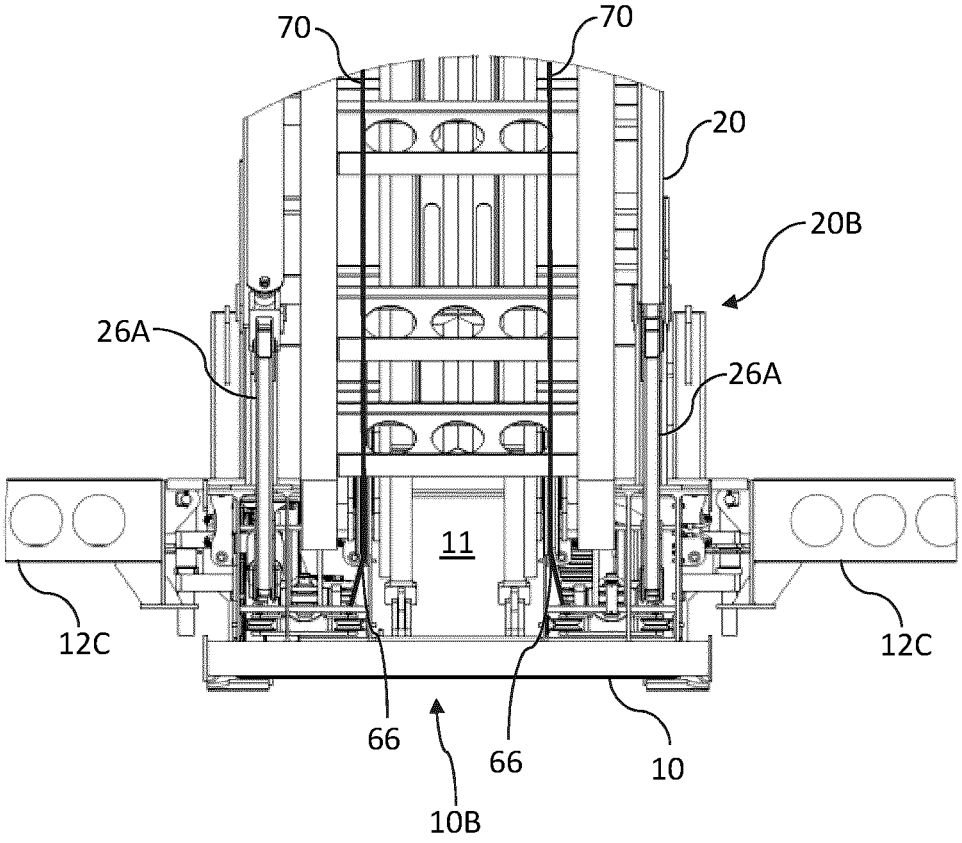
FIG. 18 is a zoomed, front elevation view of the pipe handling apparatus, according to embodiments of the present disclosure.

Together at least FIG. 9, FIG. 16 and FIG. 18 depict aspects of the actuator, shiv and cable system that is employed to move the pipe carrier 30 along the elongate door 20. FIG. 9 shows at least one actuator 62 that is reversibly extendible within a housing of the base 10. The actuator 62 can move substantially along the longitudinal axis of the base 10. Fixed at an end of the actuator 62 that is closest to the first end 10A, is a first shiv 64 (note that FIG. 9 and FIG. 16 are partial cut away views and that is why only one shiv is depicted). In some embodiments of the present disclosure, the actuator 62 is a hydraulic cylinder that is part of the power system 50's hydraulic circuit. Whereby the flow of hydraulic fluid into the cylinder causes the actuator 62 to extend and move the first shiv 64 towards the first end 10A of the base 10. FIG. 9 shows the actuator 62 in a non-extended position (compressed position) and FIG. 16 shows the same view with the actuator 62 extended, hence the first shiv 64 is no longer in view.

Figure 24:
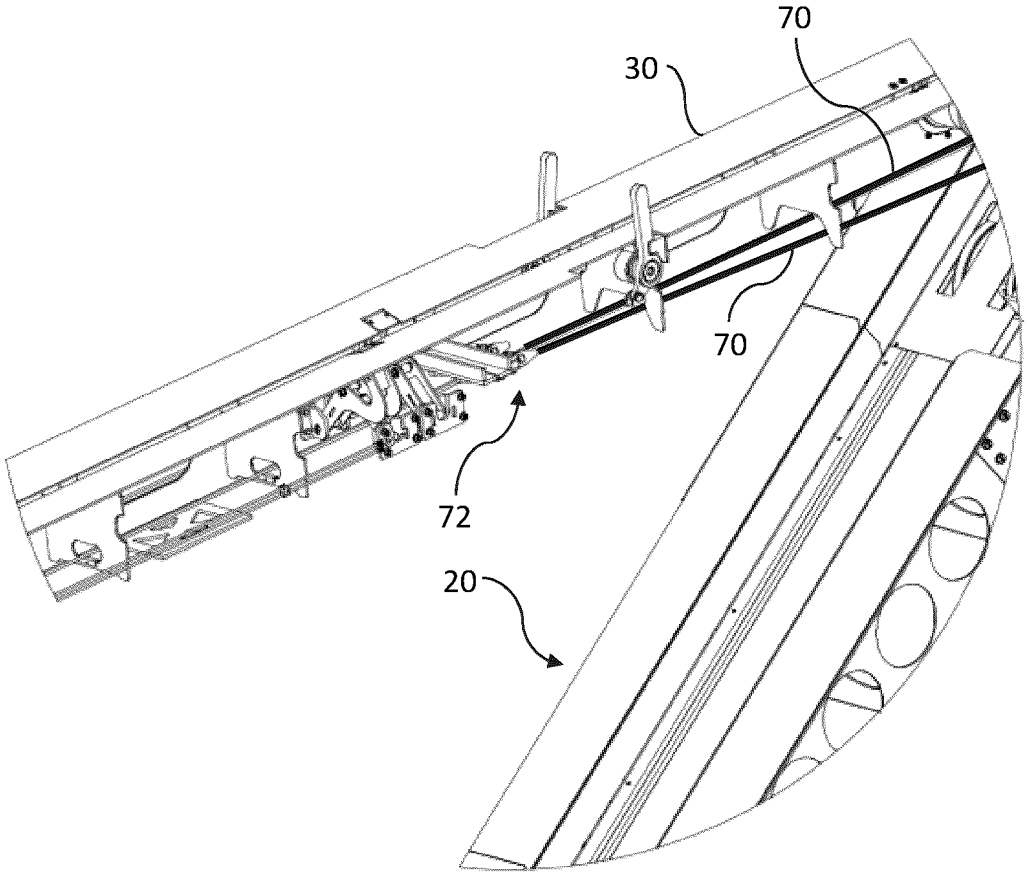
FIG. 24 is a partial cut-away section of the pipe carrier that shows a point where a cable connects to the pipe carrier.
Figure 25:
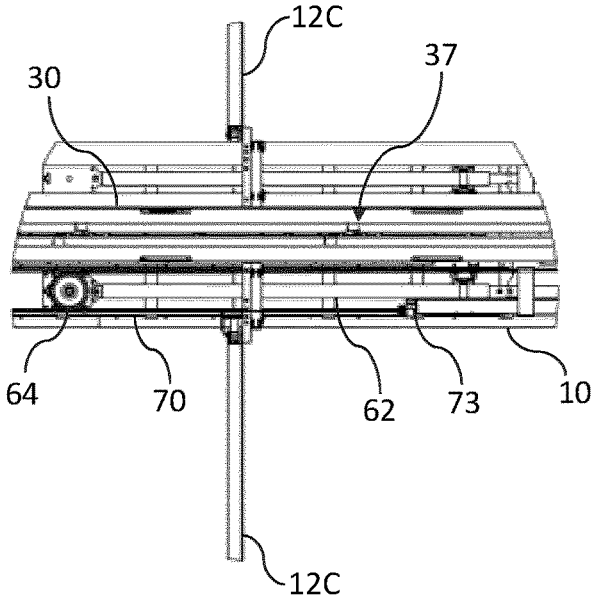
FIG. 25 is a top plan view of the base that shows a point where the cable is connected to the base.

FIG. 18 shows a set of second shivs 66 that are positioned proximal the second end 10B of the base 10. FIG. 26 shows a third shiv 68 that is positioned proximal the first end of the elongate door 20. A cable 70 is fixed at one end a cable fixing point 73 on the base 10 and at an opposite end at cable fixing point 72 on the pipe carrier 30 (see FIG. 24). Between the two fixing points 72, 73, the cable 70 extends at least partially about the first shiv 64 (at one end of the actuator 62), at least partially about the second shiv 66 (proximal the second end 10B) and at least partially about the second shiv 68. So that when the actuator 62 extends, the cable 70 pulls the pipe carrier 30 to move—in this case upwardly along the elongate door 20. If the actuator 62 is moved towards the non-extended position, the cable 70 will allow the pipe carrier 30 (under the force of gravity, its own weight) to move—in this case downwardly—along the elongate door 20. As will be appreciated by the person skilled in the art, the first shiv 64, the second shiv 66 and the third shiv 68 can each be two or more shivs positioned as described above.

Some embodiments of the present disclosure relate to a pipe handling apparatus for use with an oil and gas well rig. The pipe handling apparatus comprising a base, an elongate door, a pipe carrier and a lift member. The base that is supportable by a first surface. The elongate door comprises a first end and a second end and is pivotally connected to the base at the second end. The elongate door is pivotally moveable about the second end between a collapsed position and an extended position. When the elongate door is in the extended position the first end is positionable to abut an operational floor of a rig. The pipe carrier comprises a first end and a second end that is supported by the base and that is configured to receive and support an elongate pipe. The lift member is supported by the base and is pivotally connected at a first end to the pipe carrier and pivotally connected at a second end to the base by a collapsible extension. The lift member is moveable along the base towards and away from the second end of the elongate door. When the lift member moves towards the second end of the elongate door, the collapsible extension collapses forming a pivot point and causing the first end of the lift member to moves upwardly and arcuately towards the elongate door.

Further embodiments of the present disclosure relate to a pipe handling apparatus for use with an oil and gas well rig. The pipe handling apparatus comprises a base, an elongate door, a pipe carrier and a lift member. The base is supportable by a first surface. The elongate door comprises a first end and a second end and is pivotally connected to the base at the second end. The elongate door is pivotally moveable about the second end between a collapsed position and an extended position. When the elongate door is in the extended position the first end is positionable to abut an operational floor of a rig. The pipe carrier is supported by the base and comprises a first end and a second end that is supported by the elongated door and that is configured to receive and support an elongate pipe. The second end comprising a bearing surface that is moveable along the elongate door. The lift member is supported by the base and the lift member is pivotally connected at a first end to the pipe carrier and pivotally connected at a second end to the base. The lift member is also moveable along the base towards and away from the second end of the elongate door. When the lift member moves towards the second end of the elongate door, the lift member moves upwardly and arcuately for elevating the second end of the pipe carrier towards and not past the first end of the elongate door.

Further embodiments of the present disclosure relate to a pipe handling apparatus for use with an oil and gas well rig. The pipe handling apparatus comprising a base, a power section, an elongate door, a pipe carrier and a cable. The base is supportable by a first surface. The base comprises a first end and a second end and is configured to house an actuator that comprises a first shiv connected thereto. The actuator is configured to move between a contracted position and an extended position. The power section is configured to move the actuator between the contracted position and the extended position. The elongate door comprises a first end and a second end and is pivotally connected to the base at the second end. The elongate door is pivotally moveable about the second end between a collapsed position and an extended position. When the elongate door is in the extended position, the first end is positionable to abut an operational floor of a rig. The elongate door further comprises a second shiv positioned proximal the second end and a third shiv positioned proximal the first end. The pipe carrier comprises a first end and a second end and is configured to receive and support an elongate pipe. The cable is connected at a first end to the base and is connected at a second end to the carrier arm. The cable also extends about a portion of the first shiv, about a portion of the second shiv and about a portion of the third shiv. When the actuator moves towards the extended position, under control of the power section, the cable travels about at least a portion of the first shiv, at least a portion of the second shiv and at least a portion of the third shiv to cause the second end of the pipe carrier to move upwardly towards the first end of the elongate door.

Further embodiments of the present disclosure relate to a pipe handling apparatus for use with an oil and gas well rig. The pipe handling apparatus comprises a base, an elongate door, a coupler, a first actuator, a second actuator and a power section. The base is supportable by a first surface. The elongate door comprises a first end and a second end and that is pivotally connected to the base at the second end. The elongate door is pivotally moveable about the second end between a collapsed position and an extended position. When the elongate door is in the extended position, the first end is positionable to abut an operational floor of a rig. The coupler is positioned between the base and the second end. The first actuator is operatively coupled to a first end of the coupler and the elongate door. The second actuator is operatively coupled to a second end of the coupler and the base. The power section is configured to move the first actuator and the second actuator each between a contracted position and an extended position. Movement of the first actuator moves the elongate door through a first portion of between the collapsed position and the extended position and wherein movement of the second actuator moves the elongate door through a second portion of the between the collapsed position and the extended position.

What is claimed is:

1. A pipe handling apparatus for use with an oil and gas well rig, the pipe handling apparatus comprising:

(a) a base that is supportable by a first surface;

(b) an elongate door with a first end and a second end and that is pivotally connected to the base at the second end, the elongate door is pivotally moveable about the second end between a collapsed position and an extended position, when in the extended position the first end is positionable to abut an operational floor of a rig, the elongate door defining a guide channel that extends between the first end and the second end and the elongate door further defining a first shoulder proximal the first end;

(c) a pipe carrier with a first end that is supported by the base, and a second end that is supported by the elongate door, and that is configured to receive and support an elongate pipe, the second end comprising a bearing surface that is moveable along the guide channel for restricting lateral movement of the pipe carrier, the second end defining a second shoulder; and (d) a lift member that is supported by the base and the lift member is pivotally connected at a first end to the pipe carrier and pivotally connected at a second end to the base and the lift member is moveable along the base towards and away from the second end of the elongate door, wherein when the lift member moves towards the second end of the elongate door, the lift member moves upwardly and arcuately for elevating the second end of the pipe carrier towards the first end of the elongate door, and when the second end of the pipe carrier is positioned proximal the first end of the elongate door, the first shoulder and the second shoulder abut preventing the second end of the pipe carrier moving past the first end of the elongate door.

2. The pipe handling apparatus of claim 1, wherein the lift member is pivotally connected at the second end to the base by a collapsible extension and the lift member is moveable along the base towards and away from the second end of the elongate door, wherein when the lift member moves towards the second end of the elongate door, the collapsible extension collapses forming a pivot point and causing the first end of the lift member to move upwardly and arcuately towards the elongate door.

3. The pipe handling apparatus of claim 2, wherein the collapsible extension is arranged in a nested configuration within the lift member so that when the lift member slides towards the second end of the elongate door, at least a portion of the collapsible extension is received within the lift member.

4. The pipe handling apparatus of claim 1, wherein the pipe carrier further comprises a carrier extension that pivotally extends from the second end of the pipe carrier for supporting at least a portion of the elongate pipe beyond the first end of the elongate door when the pipe carrier is positioned proximal the first end of the elongate door.

5. The pipe handling apparatus of claim 1, wherein the base has a first end and a second end and is configured to house an actuator that comprises a first sheave connected thereto, wherein the actuator is configured to move between a contracted position and an extended position, wherein the elongate door further comprises a second sheave positioned proximal the second end and a third sheave positioned proximal the first end, wherein the pipe handling apparatus further comprises a cable that is connected at a first end to the base and that is connected at a second end to the pipe carrier and that extends about a portion of the first sheave, about a portion of the second sheave and about a portion of the third sheave, wherein when the actuator moves between the contracted position and the extended position under control of a power section, the cable travels about at least a portion of the first sheave, at least a portion of the second sheave and at least a portion of the third sheave to cause the second end of the pipe carrier to move upwardly towards the first end of the elongate door.

6. The pipe handling apparatus of claim 5, further comprising:

(a) a coupler that is positioned between the base and the second end of the elongate door;

(b) a first actuator that is operatively coupled to a first end of the coupler and the elongate door;

(c) a second actuator that is operatively coupled to a second end of the coupler and the base; and wherein the power section is configured to move each of the first actuator and the second actuator between a contracted position and an extended position, wherein movement of the first actuator moves the elongate door through a first portion of between the collapsed position and the extended position and wherein movement of the second actuator moves the elongate door a second portion of between the collapsed position and the extended position.

7. The pipe handling apparatus of claim 6, wherein the power section comprises a hydraulic circuit for controlling movement of each of the first actuator and the second actuator.

8. The pipe handling apparatus of claim 6, wherein the power section is configured to move the first actuator independently of the second actuator.

9. The pipe handling apparatus of claim 1, wherein the elongate door comprises an intermediate section positioned between the first end and the second end, wherein the intermediate section is removeable and replaceable with a second intermediate section with a different length than a length of the intermediate section.

* * * * *